US009201341B2

(12) United States Patent
Tsuritani et al.

(10) Patent No.: US 9,201,341 B2
(45) Date of Patent: Dec. 1, 2015

(54) DEVELOPER CONTAINER, DEVELOPING DEVICE, PROCESSING UNIT, IMAGE FORMING DEVICE, AND METHOD OF MANUFACTURING DEVELOPER CONTAINER

(71) Applicants: Shoh Tsuritani, Osaka (JP); Naoki Nakatake, Hyogo (JP); Manabu Hamada, Osaka (JP); Tomohiro Kubota, Osaka (JP)

(72) Inventors: Shoh Tsuritani, Osaka (JP); Naoki Nakatake, Hyogo (JP); Manabu Hamada, Osaka (JP); Tomohiro Kubota, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/287,345

(22) Filed: May 27, 2014

(65) Prior Publication Data

US 2014/0356004 A1 Dec. 4, 2014

(30) Foreign Application Priority Data

Jun. 3, 2013 (JP) ..... 2013-116931

(51) Int. Cl.

| | |
|---|---|
| ***G03G 15/00*** | (2006.01) |
| ***G03G 21/18*** | (2006.01) |
| ***G03G 15/08*** | (2006.01) |

(52) U.S. Cl.

CPC ..... *G03G 15/0865* (2013.01); *G03G 15/0863* (2013.01); *G03G 15/0894* (2013.01); *G03G 21/18* (2013.01); *G03G 21/181* (2013.01); *G03G 21/1896* (2013.01)

(58) Field of Classification Search

CPC ..... G03G 15/0865; G03G 15/181

See application file for complete search history.

(56) References Cited

U.S. PATENT DOCUMENTS

| | | | | |
|---|---|---|---|---|
| 2013/0028638 | A1 | 1/2013 | Tsuritani et al. | |
| 2013/0236197 | A1 * | 9/2013 | Yoshida et al. | 399/12 |
| 2013/0259532 | A1 | 10/2013 | Kubota et al. | |
| 2013/0266347 | A1 | 10/2013 | Kubota et al. | |
| 2014/0050502 | A1 | 2/2014 | Tsuritani et al. | |
| 2014/0050507 | A1 | 2/2014 | Hamada et al. | |

FOREIGN PATENT DOCUMENTS

| | | |
|---|---|---|
| JP | 07-306576 | 11/1995 |
| WO | WO 2013/027745 A1 | 2/2013 |

OTHER PUBLICATIONS

The Extended European Search Report issued Jan. 5, 2015, in Application No. / Patent No. 14169940.5-1560 / 2811345.
U.S. Appl. No. 14/079,812, filed Nov. 14, 2013.

* cited by examiner

*Primary Examiner* — David Gray
*Assistant Examiner* — Michael Harrison
(74) *Attorney, Agent, or Firm* — Oblon, McClelland, Maier & Neustadt, L.L.P.

(57) ABSTRACT

A developer container includes: a container body that stores a developer and includes a filling port for the developer; and a container terminal that is attachable to and detachable from the container body. The container body is provided with an identifier that engages with the container terminal and is caused to change own form that can be identified from an outside, by an external force that is applied to detach the container terminal from the container body. The container body is provided with a flow preparation part that separates an inside and outside of the container body before changing the form of the identifier and that allows the air to flow between the inside and outside of the container body after changing the form of the identifier.

16 Claims, 18 Drawing Sheets

50
100
112
63
73b
73
72
64
71
62
79
71b
60
52
101
102
103
49
105
106

DEVELOPER CONTAINER, DEVELOPING DEVICE, PROCESSING UNIT, IMAGE FORMING DEVICE, AND METHOD OF MANUFACTURING DEVELOPER CONTAINER

CROSS-REFERENCE TO RELATED APPLICATIONS

The present application claims priority to and incorporates by reference the entire contents of Japanese Patent Application No. 2013-116931 filed in Japan on Jun. 3, 2013.

BACKGROUND OF THE INVENTION

1. Field of the Invention

The present invention relates to a developer container that stores an image forming developer and a method of manufacturing a developer container that stores an image forming developer. The present invention further relates to a developing device, a processing unit, and an image forming apparatus each including a developer container.

2. Description of the Related Art

Electrographic image forming apparatuses, such as a copier, a printer, a facsimile machine, or a multifunction peripheral with functions of such image forming apparatuses, consume toner that works as a developer in accordance with image forming and electrographic image forming apparatuses are supplied with toner so as not to deplete the toner in the developing device. A method of performing replacement with a toner cartridge filled with toner is known as a supply method. The toner cartridge is replaced, for example, in a way that the top cover provided to the top surface of an image forming apparatus is opened, the used toner cartridge in the apparatus is detached, and a new toner cartridge is attached in a given position in the apparatus.

It is desirable that used toner cartridges that are replaced be reused from the perspective of environment protection. In order to reuse a cartridge, the inside of the cartridge is cleaned to remove residual toner. However, disassembling the toner cartridge to clean it leads to a complex work, which increases the cost disadvantages. In view of such circumstances, there has been a demand for toner cartridges from which residual toner can be removed without disassembling the toner cartridges in order for reusing the toner cartridges, etc. For example, Japanese Laid-open Patent Publication No. 7-306576 discloses a toner container that satisfies the demand. The toner container includes a suction hole formed on one end surface for sucking residual toner and at least one air inflow hole formed in the vicinity of the corner that is opposed to the suction hole.

On the other hand, an increase in the number of times a toner cartridge is leads to a problem of strength degradation of the toner cartridge. In order to prevent excessive reuse of the toner cartridge, it is desired to determine whether the toner cartridge to be reused is a new cartridge or a reuse cartridge that has been already used (confirm the history of the toner cartridge). The toner container disclosed in Japanese Laid-open Patent Publication No. 7-306576 requires sealing of the air inflow hole with a seal member etc. regardless whether it is a new one or a reuse one and thus, when the toner container is attached to the image forming apparatus, it is difficult to specify whether the toner container is a new one or a reuse one from only the appearance of the toner container.

In view of the above-described circumstances, there is a need to provide a developer container that provides both cleaning efficiency and easy check on a history.

SUMMARY OF THE INVENTION

It is an object of the present invention to at least partially solve the problems in the conventional technology.

A developer container includes: a container body that stores a developer and includes a filling port for the developer; and a container terminal that is attachable to and detachable from the container body and is electrically connectable to a terminal of an image forming apparatus. The developer container is attachable to and detachable from the image forming apparatus and, when attached to the image forming apparatus, is electrically connected to the terminal of the image forming apparatus. The container body is provided with an identifier that engages with the container terminal and that is caused to change own form that can be identified from an outside, by an external force that is applied to detach the container terminal from the container body. The container body is provided with a flow preparation part that separates an inside and outside of the container body before changing the form of the identifier and that allows the air to flow between the inside and outside of the container body after changing the form of the identifier.

A developer container includes: a container body that stores a developer and includes a filling port for the developer; and a container terminal that is attachable to and detachable from the container body and is electrically connectable to a terminal of an image forming apparatus. The developer container is attachable to and detachable from the image forming apparatus and, when attached to the image forming apparatus, is electrically connected to the terminal of the image forming apparatus. The container body includes an airflow hole that allows the air to flow between an inside and an outside of the container body. The airflow hole is formed by separating an identifier that engages with the container terminal, from the container body with an external force that is applied to detach the container terminal from the container body.

A method manufactures a developer container including: a container body that stores a developer and includes a filling port for the developer; and a container terminal that is attachable to and detachable from the container body and is electrically connectable to a terminal of an image forming apparatus. The developer container is attachable to and detachable from the image forming apparatus and, when attached to the image forming apparatus, is electrically connected to the terminal of the image forming apparatus. The method includes: changing a form of an identifier that is provided to the container body and engages with the container terminal with an external force that is applied to detach the container terminal from the container body; providing the apparatus with an airflow hole that allows the air to flow between an inside and outside of the container body according to change of the form of the identifier; sucking the residual developer in the container body from the filling port of the container body after the providing; and filling the container body with the developer via the filling port after the sucking.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
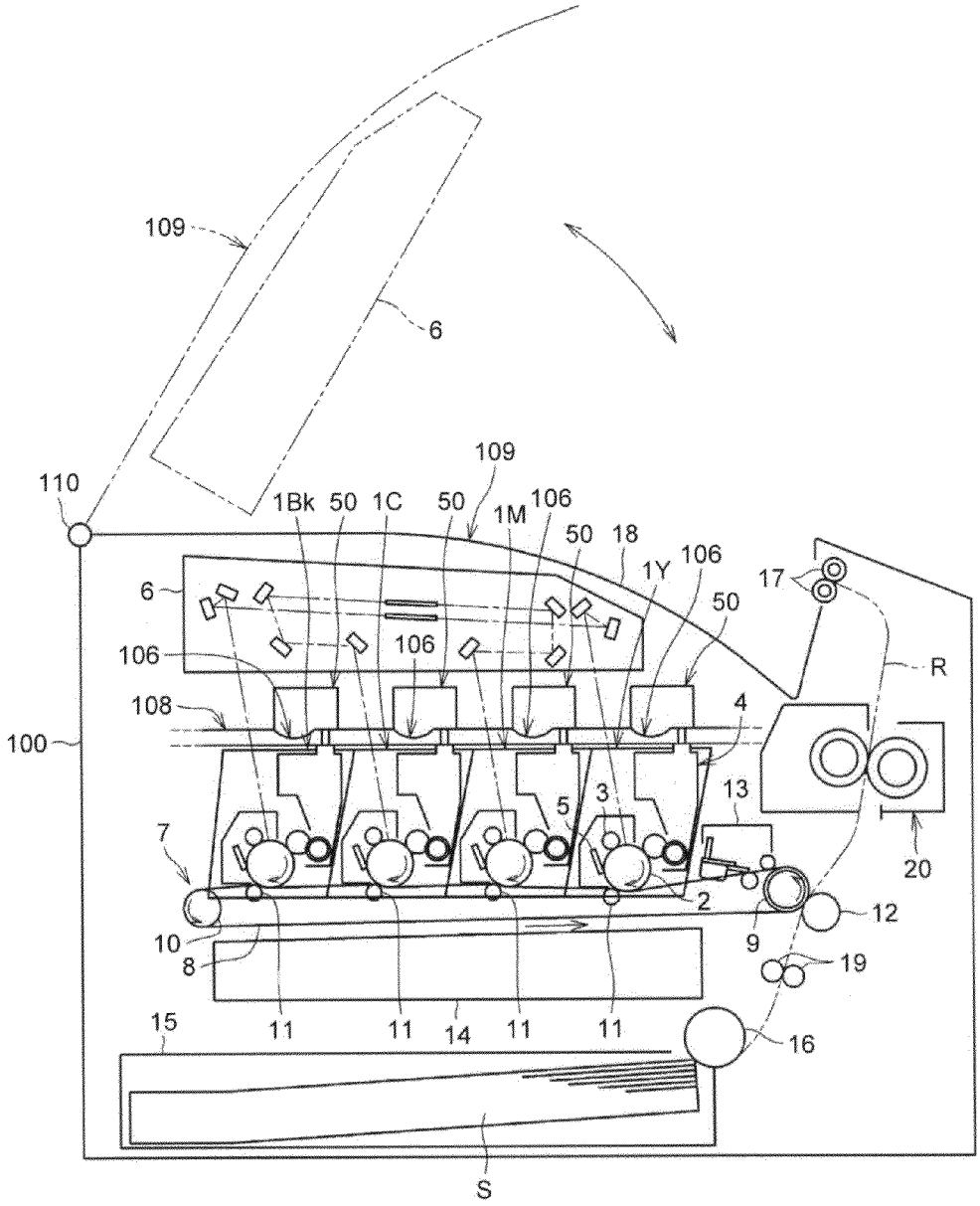
FIG. 1 is a schematic configuration diagram of an image forming apparatus according to an embodiment of the present invention.

Embodiments of the present invention will be described below with reference to the accompanying drawings. Redundant descriptions will be omitted below by denoting the same components such as parts and members with the same function or the same shape with the same reference numerals as long as they can be identified.

First, the overall configuration and operations of a color laser printer that is an embodiment of the present invention will be described below with reference to FIG. 1, but the invention is not limited to this. The configuration of the invention can be applied to image forming apparatuses, such as a monochrome printer, other types of printers, a copier, a facsimile machine, or a multifunction peripheral with functions of such image forming apparatuses.

As shown in FIG. 1, four processing units 1Y, 1M, 1C and 1Bk are detachably attached to an apparatus main unit (image forming apparatus main unit) 100 of the color laser printer. Each of the processing units 1Y, 1M, 1C, and 1Bk have the same configuration except that the processing units 1Y, 1M, 1C, and 1Bk respectively store developers of different colors: yellow (Y), magenta (M), cyan (C), and black (Bk).

Specifically, each of the processing units 1Y, 1M, 1C and 1Bk includes: a drum-shaped photosensitive element 2 serving as a latent image carrier; a charge device that includes a charge roller 3 that causes the surface of the photosensitive element 2 to be electrically charged; a developing device 4 that supplies a developer to a latent image on the photosensitive element 2; and a cleaning device that includes a cleaning blade 5 for cleaning the surface of the photosensitive element 2. In FIG. 1, only the photosensitive element 2, the charge roller 3, the developing device 4, the cleaning blade 5, etc. of the processing unit 1Y for yellow are denoted by reference numerals and reference numerals for other processing units 1M, 1C, and 1Bk are not shown. In the embodiment, a single-component developer consisting of toner is used as the developer. Alternatively, the developer may be a two-component developer consisting of toner and carriers.

A toner cartridge 50 that serves as a developer container and that stores toner with which each developing device 4 is supplied is provided above each of the four developing devices 4 of the processing units 1Y, 1M, 1C and 1Bk. In the embodiment, a partition 108 that composes a base member 107, which will be described below, is provided between each developing device 4 and each toner cartridge 50. The toner cartridges 50 are detachably attached to four attachment parts 106 that are formed in the partition 108, respectively.

An exposure device 6 that exposes the surface of the photosensitive element 2 of each of the processing units 1Y, 1M, 1C, and 1Bk is provided above each of the toner cartridges 50. The exposure device 6 includes a light source, a polygon mirror, an f-θ lens, a reflection mirror, etc. and irradiates the surface of each of the photosensitive elements 2 with laser light on the basis of image data.

A top cover 109 that can be opened upward or closed downward by turning the top cover 109 about a fulcrum 110 is provided to the top of the apparatus main unit 100. The exposure device 6 is attached to the top cover 109. Thus, when the top cover 109 is opened, the exposure device 6 can be withdrawn from the area above the toner cartridges 50 and, in that state, the toner cartridge 50 can be detached from the top opening of the apparatus main unit 100.

A transfer device 7 is provided under the processing units 1Y, 1M, 1C and 1Bk. The transfer device 7 includes an intermediate transfer belt 8 made with an endless belt serving as a transfer member. The intermediate transfer belt 8 extends between a drive roller 9 and a driven roller 10 that serve as support members. The intermediate transfer belt 8 is configured to loop (rotate) in the direction indicated by the arrow in FIG. 1 as the drive roller 9 rotates counterclockwise.

Four primary transfer rollers 11 each serving as a primary transfer unit are provided in positions opposed to the four photosensitive elements 2, respectively. Each of the primary transfer rollers 11 pushes the inner surface of the intermediate transfer belt 8 in each position so that a primary transfer nip is formed in a spot where the pushed part and each photosensitive element 2 make contact with each other. Each of the primary transfer rollers 11 is connected to a power supply (not shown) and a given direct current (DC) voltage and/or an alternative current (AC) voltage is applied to each of the primary transfer rollers 11.

A secondary transfer roller 12 serving as a secondary transfer unit is provided in a position opposed to the drive roller 9. The secondary transfer roller 12 pushes the outer surface of the intermediate transfer belt 8 so that a secondary transfer nip is formed in a spot where the secondary transfer roller 12 and the intermediate transfer belt 8 make contact with each other. The secondary transfer roller 12 is connected to the power supply (not shown) as the primary transfer roller 11 is and a given direct current (DC) voltage and/or an alternative current (AC) voltage is applied to the secondary transfer roller 12.

A belt cleaning device 13 is provided to the outer surface of the intermediate transfer belt 8 on the right end side of FIG. 1. A waste toner transfer hose (not shown) extending from the belt cleaning device 13 is connected to an inlet of a waste toner container 14 that is provided under the transfer device 7.

A sheet feeding cassette 15 that stores recording media S is provided under the apparatus main unit 100. The sheet feeding cassette 15 is provided with a sheet feeding roller 16 that sends out a stored recording media S. In contrast, a pair of discharge rollers 17 is provided above the apparatus main unit 100. Furthermore, an discharge tray 18 for stocking recording media that are discharged by the discharge rollers 17 is provided to the top cover 109. Recording media includes, in addition to general-use paper, thick paper, postcards, envelopes, thin paper, coated paper (such as art paper), tracing paper, and OHP sheets.

A transfer route R for transferring a recording medium S from the sheet feeding cassette 15 to the discharge tray 18 via the secondary transfer nip is provided in the apparatus main unit 100. A pair of registration rollers 19 serving as a transfer unit that transfers a recording medium to the secondary nip at right timing is provided on the upstream side with respect to the secondary transfer roller 12 on the transfer route R in the direction in which a recording medium is transferred. A fixing device 20 is provided on the downstream side with respect to the secondary transfer roller 12 in the direction in which a recording medium is transferred.

The image forming apparatus operates as described below.

When an image forming operation starts, the photosensitive elements 2 of the processing units 1Y, 1M, 1C and 1Bk are driven to rotate clockwise as illustrated in FIG. 1. The charge roller 3 causes the surface of each of the photosensitive elements 2 to be electrically charged uniformly with a given polarity. The charged surface of each of the photosensitive elements 2 is irradiated with laser light from the exposure device 6 on the basis of the image information on a document that is read by an image reading device (not shown) so that an electrostatic latent image is formed on the surface of each of the photosensitive elements 2. The image information with which each of the photosensitive elements 2 is exposed is single-color image information of yellow, magenta, cyan, and black decomposed from a desired full color image. The developing devices 4 supply toner to the electrostatic latent images formed on the photosensitive elements 2 so that the electrostatic latent images are turned into toner images, i.e., developed (made visible).

Subsequently, the drive roller 9 to which the intermediate transfer belt 8 stretches is driven to rotate to cause the intermediate transfer belt 8 to loop in the direction denoted by the arrow shown in FIG. 1. A constant voltage of the polarity opposite to that of toner or a voltage of a constant current is applied to each of the primary transfer rollers 11 so that a transfer electric field is formed in the primary transfer nip between each of the primary transfer rollers 11 and each of the photosensitive elements 2. The transfer electric fields that are formed in the primary transfer nips cause the toner images of the respective colors on the photosensitive elements 2 to be sequentially transferred in a superimposed manner on the intermediate transfer belt 8. Accordingly, the intermediate transfer belt 8 carries a full-color toner image on its surface. The toner on the photosensitive elements 2 that has not been transferred to the intermediate transfer belt is removed by the cleaning blades 5.

On the other hand, the sheet feeding roller 16 rotates in the sheet feeding cassette 15 so that a recording medium S is sent out to the transfer route R. The registration roller 19 sends the recording medium S, which was sent out to the transfer route R, to the secondary transfer nip between the secondary transfer roller 12 and the intermediate transfer belt 8 at right timing. The secondary transfer roller 12 is applied with a transfer voltage of a polarity opposite to that of the toner of the toner image on the intermediate transfer belt 8, which forms a transfer electric filed in the secondary transfer nip. The transfer electric field that is formed in the secondary transfer nip causes the toner image on the intermediate transfer belt 8 to be transferred to the recording medium S at a time. The residual toner on the intermediate transfer belt 8 after the transfer is removed by the belt cleaning device 13 and the removed toner is conveyed to the waste toner container 14 and collected.

The recording medium S with the transferred toner image is then conveyed to the fixing device 20 and the fixing device 20 fixes the toner image on the recording medium S to the recording medium S. The recording medium S is then discharged by the discharge rollers 17 to the outside of the apparatus and is stocked in the discharge tray 18.

The image forming operation for forming a full color image on a recording medium has been described. Alternatively, any one of the four processing units 1Y, 1M, 1C and 1Bk may be used to form a single-color image or any two or three processing units may be used to form a two-color or three-color image.

Figure 2:
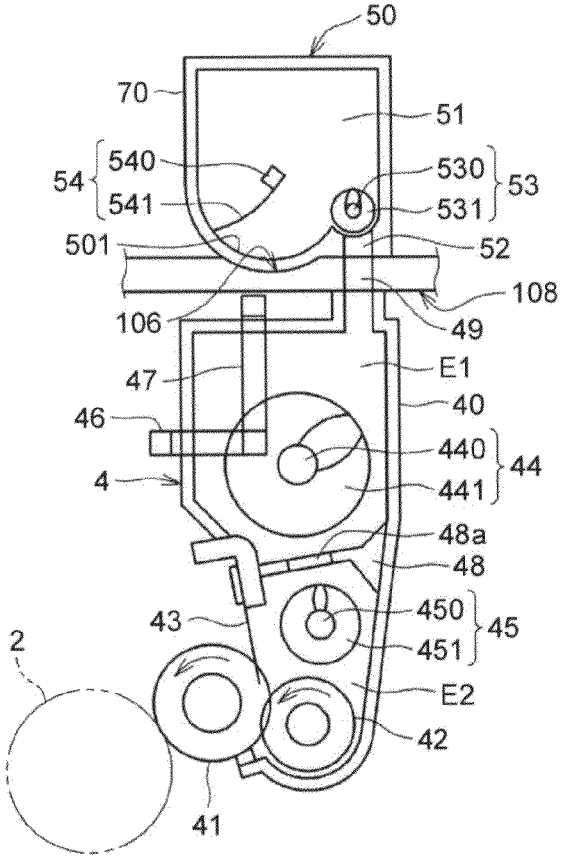
FIG. 2 is a schematic cross-sectional view of a developing device and a toner cartridge.

As illustrated in FIG. 2, the developing device 4 includes a development housing 40 that stores toner, a developing roller 41 serving as a developer carrier that carries toner, a supply roller 42 serving as a developer supply member that supplies toner to the developing roller 41, a development blade 43 serving as a control member that controls the amount of toner carried on the developing roller 41, and two conveyance screws 44 and 45 serving as a conveyance member that conveys toner.

The inside of the development housing 40 is partitioned with a partition 48 with a communication port 48*a* into an upper first area E1 shown in FIG. 2 and a lower second area E2 shown in FIG. 2. The communication port 48*a* is provided to each of both ends of the partition 48 (the front side and the back side in the direction orthogonal to the page of FIG. 2). In other words, the first area E1 and the second area E2 communicate to each other in spots where the two communication ports 48*a* are formed.

The conveyance screw 44 is disposed in the first area E1. The transfer screw 45 and the supply roller 42 are disposed in the second area E2. The developing roller 41 and the development blade 43 are provided at the opening of the second region E2 that is opposed to the photosensitive element 2.

The two conveyance screws 44 and 45 are formed by providing spiral blades 441 and 451 on the periphery of rotation shafts 440 and 450. When the conveyance screws 44 and 45 rotate, the toner is conveyed in the directions of the respective shafts. The directions in which toner is conveyed by the conveyance screws 44 and 45 are opposite to each other.

The developing roller 41 consists of a core metal made of metal and a conductive rubber provided to the periphery of the core metal. In the embodiment, the outer diameter of the core metal is set at ϕ6, the periphery of the conductive rubber is set at ϕ12, and the rubber hardness degree is set at 75 Hs. The volume resistivity of the conductive rubber is adjusted to be approximately $10^5$ to $10^7\Omega$. For example, conductive polyurethane rubber, silicone rubber, etc. can be used as the conductive rubber. The developing roller 41 rotates counterclockwise as illustrated in FIG. 2 to convey the developer held on its surface to the position where the developing roller 41 is opposed to the development blade 43 and the photosensitive element 2.

Generally, a sponge roller etc. is used as the supply roller 42. A sponge roller is appropriate that is obtained by attaching expanded polyurethane in which carbon is mixed to make expanded polyurethane semi-conducting to the periphery of the carbon made of metal. In the embodiment, the outer diameter of the cored bar is set at ϕ6 and the outer diameter of the sponge part is set at ϕ12. The supply roller 42 makes contact with the developing roller 41. The nip part that is formed due to the contact between the supply roller 42 and the developing roller 41 is usually set at approximately 1 to 3 mm. In the embodiment, the nip is 2 mm. The supply roller 42 rotates in the counter direction with respect to the developing roller 41 (anticlockwise as shown in FIG. 2) so that the toner in the development housing 40 can be efficiently supplied to the top layer of the developing roller 41. Furthermore, in the embodiment, by setting the ratio of rotation between the developing roller 41 and the supply roller 42 at 1, a preferable toner supply function is secured.

The development blade 43 consists or, for example, made of a metal plate, such as SUS, with a thickness of approximately 0.1 mm. The tip of the development blade 43 makes contact with the surface of the developing roller 41. Control on the amount of toner on the developing roller 41 with the development blade 43 is a very important parameter for steady development properties and preferable image quality. Thus, for general products, the contact pressure of the development blade 43 with respect to the developing roller 41 is strictly controlled at approximately 20 N/m to 60 N/m and the nip position is strictly controlled to be apart from the top of the development blade 43 by approximately 0.5±0.5 mm. These parameters are determined as appropriate according to the properties of the used toner, developing roller, and supply roller. In the embodiment, the development blade 43 consists of an SUS member with a thickness of 0.1 mm and the contact pressure is set at 45 N/m, the nip position is set apart from the tip of the development blade 43 by approximately 0.2 mm, and the length (free length) from the support end of the development blade 43 to its free end (tip) is set at 14 mm so that a thin tonner layer can be formed on the developing roller 41 steadily.

With reference to FIG. 2, a developing operation performed by the developing device 4 will be described here.

Once an instruction for starting an image forming operation is issued and the developing roller 41 and the supply roller 42 start rotating, the supply roller 42 supplies toner to the surface of the developing roller 41 and thus the developing roller 41 carries the toner. The toner carried on the developing roller 41 passes the nip part between the developing roller 41 and the development blade 43 so that the thickness of the toner layer is controlled and the toner is triboelectrically charged. When the toner on the developing roller 41 is conveyed to the position opposed to the photosensitive element 2 (development area), the toner is electrostatically transferred to the electrostatic latent image on the photosensitive element 2 so that a toner image is formed.

The toner cartridge 50 serving as a developer container includes a contained body 70 that includes a developer storage unit 51 that stores toner. The container body 70 is provided with a discharge port 52 for discharging toner in the developer storage unit 51 to the outside, a conveyance screw 53 serving as a conveyance member that conveys the toner in the developer storage unit 51 to the discharge port 52, and an agitator 54 serving as a stirring member that stirs the developer in the developer storage unit 51. The discharge port 52 is provided in a lower part of the developer storage unit 51. On the other hand, a supply port 49 that is connected to the discharge port 52 of the toner cartridge 50 is formed in each attachment part 106 of the partition 108 to which the toner cartridge 50 is attached.

The conveyance screw 53 is formed by providing a spiral blade 531 to the periphery of a rotation shaft 530. The agitator 54 is formed by providing a deformable plane blade 541 to a rotation shaft 540 that is provided in parallel with the rotation shaft 530 of the conveyance screw 53. The blade 541 of the agitator 54 is made of a flexible material, made of a PET film, etc. A bottom surface 501 of the developer storage unit 51 is formed in an arc along the rotation orbit of the blade 541 as illustrated in FIG. 2, which can reduce the amount of toner that has not been conveyed by the blade 541 and that remains in the developer storage unit 51.

In the embodiment, the toner cartridge 50 is attachable to and detachable from the apparatus main unit 100, but embodiments are not limited to this configuration. For example, the toner cartridge 50 may be integral with the developing device 4, the photosensitive element 2, etc. such that they can be replaced as a processing unit. Alternatively, the toner cartridge 50 may be integral with the developing device 4 such that they can be replaced as a developing unit. In such a case, the partition 108 is omitted and an attachment part like the attachment part 106 provided to the partition 108 is provided to the top of the developing device 4, which makes it possible to directly attach the toner cartridge 50 to the top of the developing device 4.

A toner supply operation will be described here.

The developing device is supplied with toner when the amount of toner in the development housing 40 is equal to or less than a given reference value. Whether the amount of toner is equal to or less than the reference value can be determined, for example, on the basis of whether light transmits between the tips of two light guide members 46 and 47 that are disposed in the first area E1. When both of the tips are buried in toner, light does not transmit from one of the conductive members to the other and thus it can be determined that the amount of toner is more than the reference value. When light transmits between the light guide members 46 and 47, it can be determined that there is no toner between both of the tips and accordingly the amount of toner is equal to or less than the reference value.

When the amount of toner is equal to or less than the reference value, the conveyance screws 53 and the agitator 54 in the toner cartridge 50 start rotating. The rotation of the conveyance screw 53 conveys the toner to the discharge port 52 and the toner is supplied from the discharge port 52 into the first area E1 of the development housing 40. The rotation of the agitator 54 stirs the toner in the toner cartridge 50 and further conveys the toner to the rotation area where the conveyance screw 53 rotates. When the amount of toner in the development housing 40 is more than the given reference value, driving of the conveyance screw 53 and the agitator 54 to rotate is stopped and the toner supply ends.

On the other hand, in the development housing 40, when toner is supplied, the conveyance screw 44 provided in the first area E1 and the conveyance screw 45 provided in the second area E2 rotate so that the toner is conveyed in the opposite directions between the areas E1 and E2. The toner that is conveyed by each of the conveyance screws 44 and 45 to the downstream end of each of the areas E1 and E2 is sent to the other area (from the area E1 to the area E2 or from the area E2 to the area E1) via each of the communication ports 48*a* that are formed on both ends of the partition 48. The toner sent into the other area is conveyed by one of the conveyance screws 44 and 45 and is returned to the original area via the communication port 48*a* on the opposite side. Repetition of this operation causes the toner to circulate between the first area E1 and the second area E2 and thus the supplied new toner is mixed with the toner in the development housing 40, which leads to a uniform state of toner (ratio of new toner with respect to the total toner) and thus prevents occurrence of error, such as uneven color or scrumming.

Figure 3:
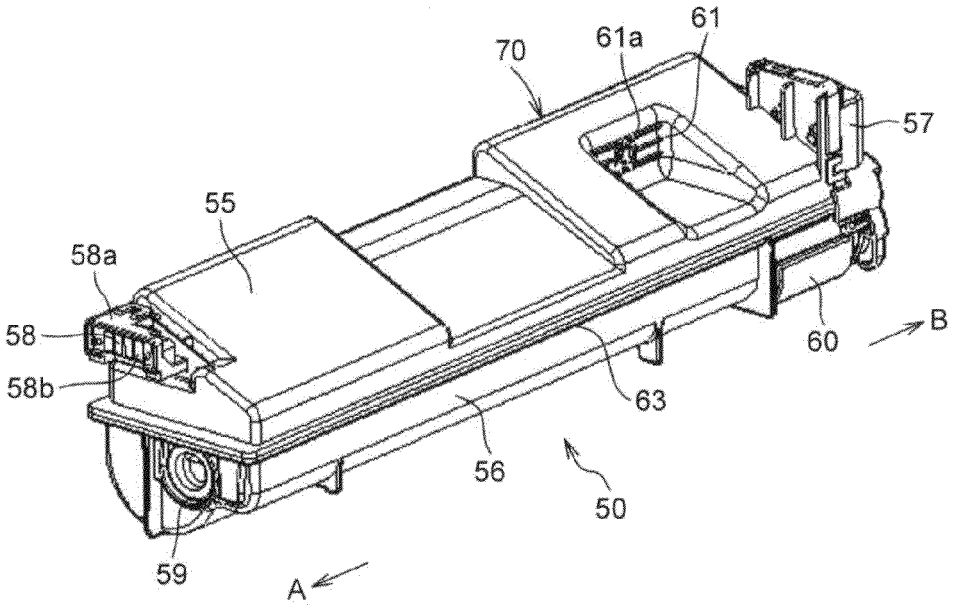
FIG. 3 is an external view of a toner cartridge.
Figure 4:
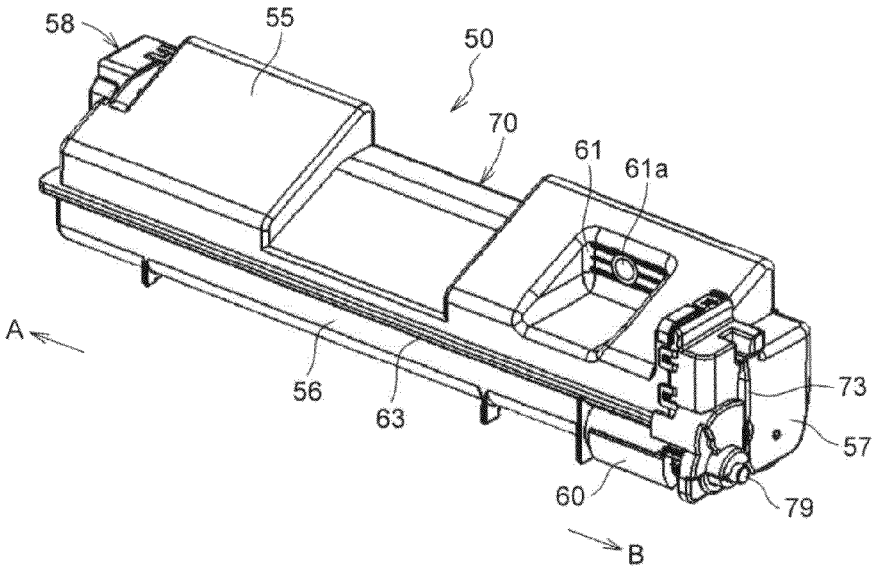
FIG. 4 is an external view of the toner cartridge viewed in the opposite direction to that in which the toner cartridge in FIG. 3 is viewed.

FIGS. 3 and 4 are perspective external views of the toner cartridge. FIG. 3 is a diagram of the toner cartridge 50 viewed from its one end (the end in the direction denoted by the arrow A) and FIG. 4 is a diagram of the toner cartridge 50 viewed from the other end (the end in the direction denoted by the arrow B).

As illustrated in FIGS. 3 and 4, the toner cartridge 50 includes the container body 70 consisting of a top case 55 and a bottom case 56, a container terminal 58 that is attached to a side surface of one end of the container body 70 (in the A direction), a gear cover 57 that covers the side surface of the other end of the container body 70 (in the B direction), and a shutter 60 that is disposed on the side of the other end of the container body 70. The container body 70 is manufactured by connecting the peripheries that are formed in the openings of the top case 55 and the bottom case 56 and a flange 63 that is formed by connecting the peripheries is formed along the periphery of the container body 70. The toner, the conveyance screw 53, and the agitator 54 are stored in the inner space of the container body 70. For a method of connecting both of the cases 55 and 56, welding, such as vibration welding or ultrasound welding, or welding using a double-faced tape or an adhesive is used.

Figure 5:
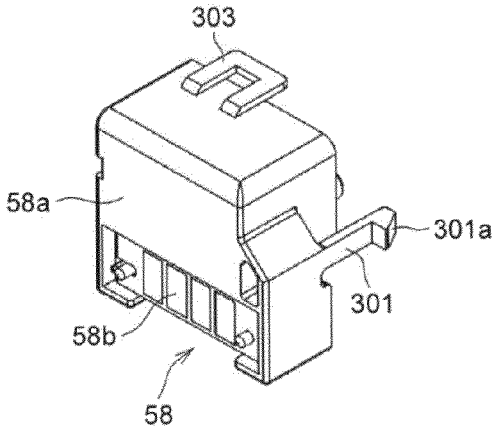
FIG. 5 is a perspective view of a container terminal.

As illustrated in FIG. 3, the container terminal 58 is attached to the side surface of one end of the container body 70, which includes the top case 55 and the bottom case 56, in the longitudinal direction. As illustrated in FIG. 5, the container terminal 58 includes a holder 58*a* and at least one (four in the embodiment) container contact 58*b* that is held by the holder 58*a*. The container contact 58*b* is platy and is connected to a memory device (not shown) consisting of an IC chip, etc. disposed in the holder 58*a*. The memory device stores information on the toner cartridge 50, such as the color and amount of the stored toner. Each contact 58*b* is caused to make contact with a main unit contact (104*b*, see FIG. 16) provided to the image forming apparatus main unit 100, which will be described below, so that the contact 58*b* and the main unit contact are electrically connected to each other. Thus, the information on the toner cartridge 50 stored in the memory device is read or the information stored in the memory device is updated. As illustrated in FIG. 3, a cap member 59 that seals a filling port for filling the toner cartridge 50 with toner is provided to the side surface of one end of the container body 70. After the toner cartridge 50 is filled with toner from the filling port, the cap member 59 is attached to prevent the toner from leaking from the filling port.

The container terminal 58 is provided to one end of the container body 70 apart from the shutter while the shutter 60 is formed on the side of the other end of the container body 70, which hinders contamination of the container terminal 58 with toner and thus increases the conductivity between the container terminal 58 and the main unit contact 104*b*.

The gear cover 57 is attached to the side surface of the other end of the container body 70 in the longitudinal direction. In the gear cover 57, multiple gears are disposed as a torque transmission unit for transmitting a drive force from the apparatus main unit to the conveyance screw 53 and the agitator 54.

The shutter 60 that opens or closes the discharge port 52 is provided to the side of the other end of the container body 70 in the longitudinal direction. The shutter 60 is rotatable along the partially cylindrical peripheral surface of the container body 70. The rotation of the shutter 60 switches between the state where the discharge port 52 shown in FIG. 2 is opened and the state where the discharge port 52 is closed.

As illustrated in FIGS. 3 and 4, a grip 61 is provided to the side of the other end of the container body 70 with respect to the center in the longitudinal direction (B direction). When the toner cartridge 50 is replaced, a user can detach the toner cartridge 50 easily by gripping the grip 61. The inner surface of the grip 61 may be provided with a circular rib 61*a* with which the user can recognize the grip 61 easily.

Figure 6:
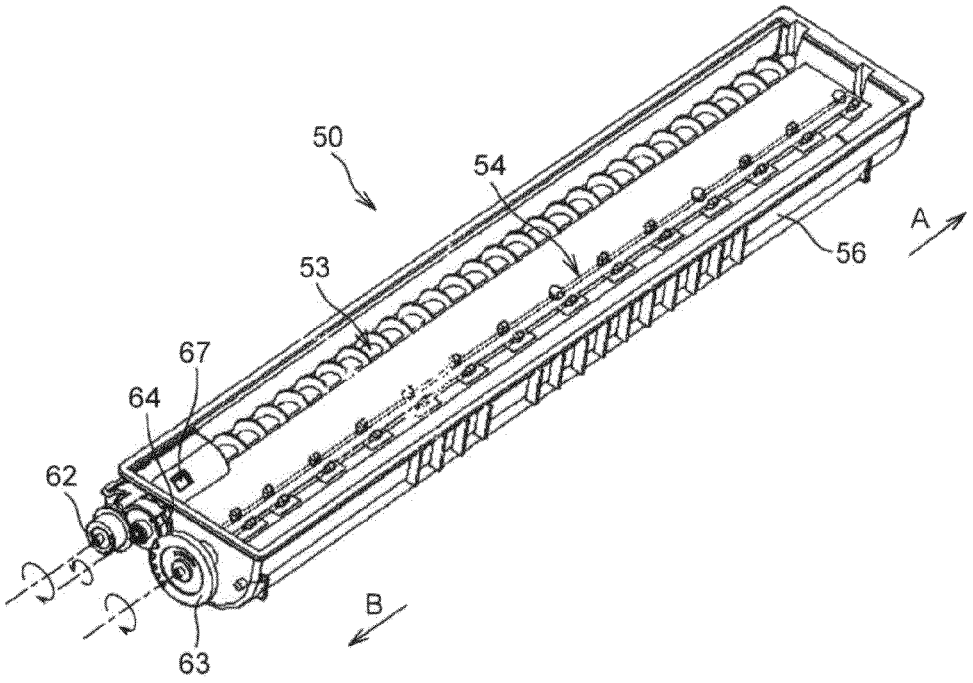
FIG. 6 is a perspective view of the toner cartridge from which a top case and a gear cover have been detached.

FIG. 6 is a perspective view of the toner cartridge 50 from which the top case 55 and the gear cover 57 are detached.

The reference numerals 62, 63, and 64 shown in FIG. 6 denote the multiple gears stored in the gear cover 57. The reference numeral 62 denotes a conveyance drive gear and the reference numeral 63 denotes a stirring drive gear. These gears 62 and 63 are respectively attached to the rotation shafts of the conveyance screw 53 and the agitator 54 that protrude from the side surface of the other end of the bottom case 56 (in the B direction). The gear denoted by the reference numeral 64 is a torque transmission gear that meshes with the conveyance drive gear 62 and the stirring drive gear 63 to transmit a rotational torque.

The apparatus main unit 100 is provided with the main unit drive gear 105 as described below (see FIGS. 17 and 18). When the toner cartridge 50 is attached to the attachment part 106 of the apparatus main unit 100, the conveyance drive gear 62 meshes with the main unit drive gear 105. When the main unit drive gear 105 in this state is rotated, the conveyance drive gear 62, the torque transmission gear 64, and the stirring drive gear 63 rotate in the directions denoted by the arrows shown in FIG. 6 and accordingly the conveyance screw 53 and the agitator 54 rotate. The conveyance drive gear 62 of the embodiment consists of a two-speed gear including a gear part with a larger diameter and a gear part with a smaller diameter. The gear part with the larger diameter meshes with the torque transmission gear 64 and the gear part with a smaller diameter meshes with the main unit drive gear 105.

Figure 7:
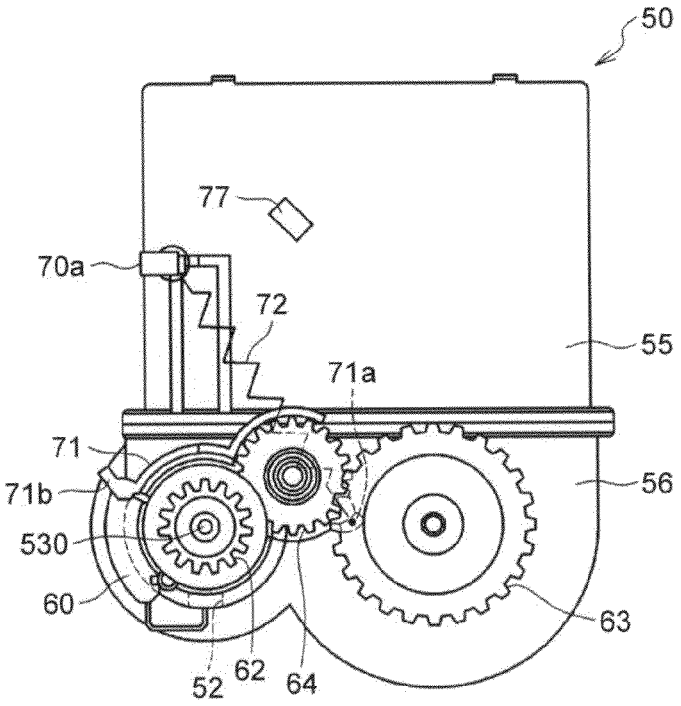
FIG. 7 is a side view of the toner cartridge from which the gear cover is detached.
Figure 8:
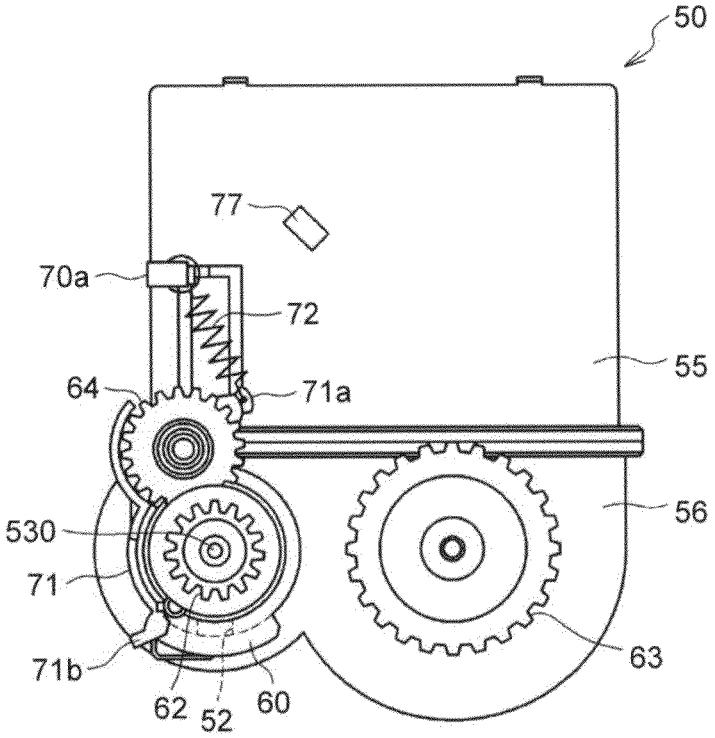
FIG. 8 is a side view of the toner cartridge from which the gear cover is detached.

FIGS. 7 and 8 are side views of the toner cartridge 50 from which the gear cover 57 is detached.

Figure 9:
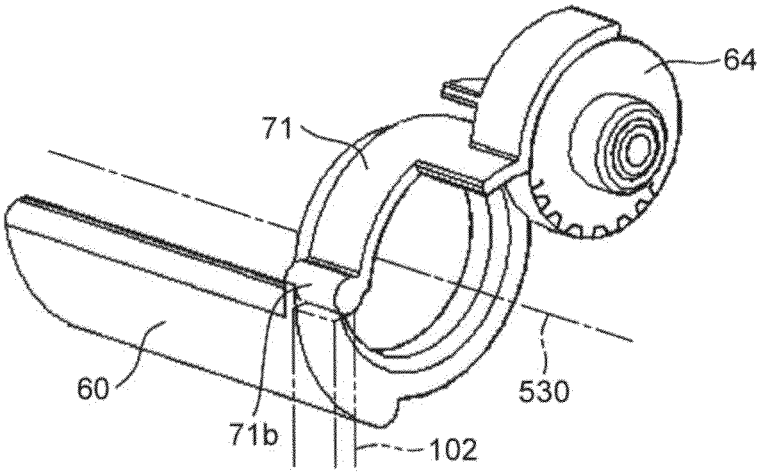
FIG. 9 is a perspective view of a gear holder.

According to the embodiment, the torque transmission gear 64 is configured to be movable between an operation position shown in FIG. 7 where the torque transmission gear 64 meshes with other gears 62 and 63 and transmits a torque and a withdrawal position shown in FIG. 8 where the meshing of the torque transmission gear 64 with other gears 62 and 63 are canceled. Specifically, as illustrated in FIG. 9, the torque transmission gear 64 is held by the gear holder 71 that is supported rotatably about the rotation shaft 530 of the conveyance screw 53 (or the conveyance drive gear 62). Rotation of the gear holder 71 in the forward and reverse directions allows switching of the torque transmission gear 64 between the operation position shown in FIG. 7 and the withdrawal position shown in FIG. 8.

As illustrated in FIG. 9, the shutter 60 (outer shutter) is integrally provided to the gear holder 71. When the gear holder 71 about the rotation shaft 530, the shutter 60 accordingly rotates about the rotation shaft 530 of the conveyance screw 53. In this case, in the states where the torque transmission gear 64 is in the operation position as illustrated in FIG. 7, the shutter 60 opens the discharge port 52. In the states where the torque transmission gear 64 is in the withdrawal position as illustrated in FIG. 8, the shutter 60 closes the discharge port 52.

As illustrated in FIGS. 7 and 8, a tension spring 72 is disposed as an actuator between the gear holder 71 and the top case 55. An end of the tension spring 72 is attached to a catch 71*a* provided to the gear holder 71 and the other end of the tension spring 72 is attached to a catch 70*a* provided to the side surface of the top case 55. The tension (actuation force) of the tension spring 72 actuates the gear holder 71 in the direction in which the torque transmission gear 64 is separated from the stirring drive gear 63. Accordingly, in the state where no external force acts on the gear holder 71, the tension of the tension spring 72 causes the torque transmission gear 64 to move to the withdrawal position as illustrated in FIG. 8.

Furthermore, as illustrated in FIG. 9, the gear holder 71 is provided with an operation part 71*b*. When the toner cartridge 50 is attached to the attachment part 106 of the apparatus main unit 100, the operation part 71*b* makes contact with the top end of the shutter control member 102 that is provided to the apparatus main unit 100. When the toner cartridge 50 is detached from the apparatus main unit 100, the operation part 71*b* separates from the shutter control member 102.

Figure 10:
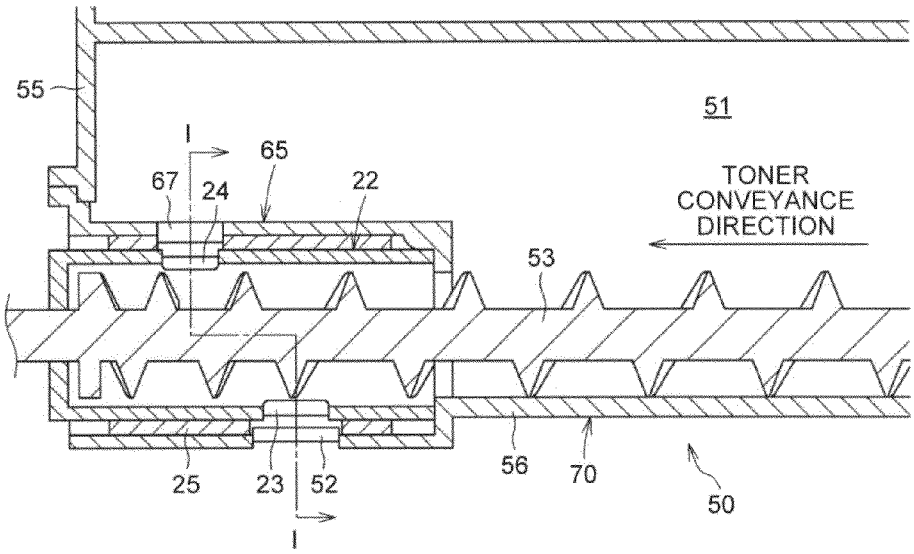
FIG. 10 is a cross-sectional view of the toner cartridge taken along the direction of the shaft of a conveyance screw in the position of the conveyance screw.

FIG. 10 is a cross-sectional view of the toner cartridge taken along the direction of the shaft of the conveyance screw in the position of the conveyance screw.

As illustrated in FIG. 10, the toner cartridge 50 of the embodiment employs a double-shutter structure where the toner cartridge 5 includes another shutter 22 in addition to the above-described shutter 60. In contrast, the shutter 60 (hereinafter, "outer shutter") opens and closes an outer opening of the discharge port 52 and the other shutter 22 (hereinafter, "inner shutter") opens and closes an inner opening of the discharge port 52. The inner shutter 22 may be omitted if it is not particularly required.

The inner shutter 22 is formed cylindrical and its peripheral wall is provided with a developer outlet 23. Rotation of the inner shutter 22 about its axial center allows switching between an opened state where the developer outlet 23 overlaps the discharge port 52 and a closed state where the peripheral wall of the inner shutter 22 overlaps the discharge port 52 (the developer outlet 23 does not overlap the discharge port 52). The conveyance screw 53 is inserted into the inner shutter 22.

The inner shutter 22 is provided with a return port 24 for returning the toner that has not been discharged from the discharge port 52 via the developer outlet 23 into the developer storage unit 51 from the inner shutter 22. The return port 24 is positioned on the downstream side with respect to the developer outlet 23 in the direction in which the toner is conveyed.

A semi-cylindrical peaked part 65 is disposed on the periphery of the inner shutter 22. The inner shutter 22 is rotatably held between the peaked part 65 and the inner wall of the container body 70.

Even if the peaked part 65 is not provided, the inner shutter 22 can be rotatably held with one end supported by the container body 70. However, the cylindrical inner surface of the peaked part 65 serves as a bearing, which enables the inner shutter 22 to rotate in a steady posture. The peaked part 65 is further provided with a return port 67 in a position corresponding to the return port 24 of the inner shutter 22.

A cylindrical seal member 25 for preventing toner from leaking to the outside is disposed between the periphery of the inner shutter 22 and the inner periphery of the inner shutter 22 and between the inner periphery of the inner shutter 22 and the inner wall of the container body 70.

Figure 11A:
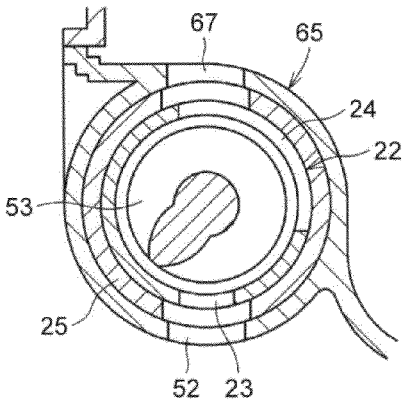
FIG. 11A is a cross-sectional view of a discharge port and the vicinity thereof in an open state.
Figure 11B:
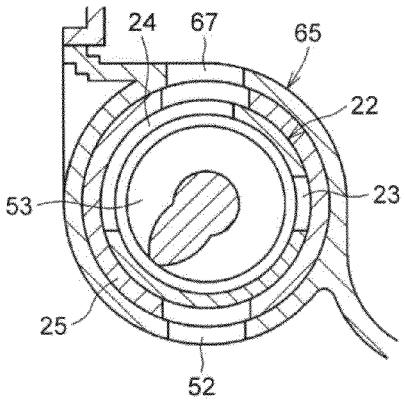
FIG. 11B is a cross-sectional view of the discharge port and the vicinity thereof in a closed state.

FIG. 11A is a cross-sectional view of FIG. 10 taken along the line I-I, indicating the opened state where the developer outlet 23 of the inner shutter 22 overlaps the discharge port 52. On the other hand, FIG. 11B indicates the closed state where the developer outlet 23 does not overlap the discharge port 52.

As FIG. 11A illustrates, the return port 24 provided to the inner shutter 22 is formed to extend in the circumferential direction of the inner shutter 22 and is open wider than the return port 24 along the circumferential direction. Forming the return port 24 of the inner shutter 22 as described above allows the return port 24 of the inner shutter 22 to partly overlap the return port 67 of the peaked part 65 regardless whether it is in the opened state illustrated in FIG. 11A or in the closed state illustrated in FIG. 11B.

Figure 12A:
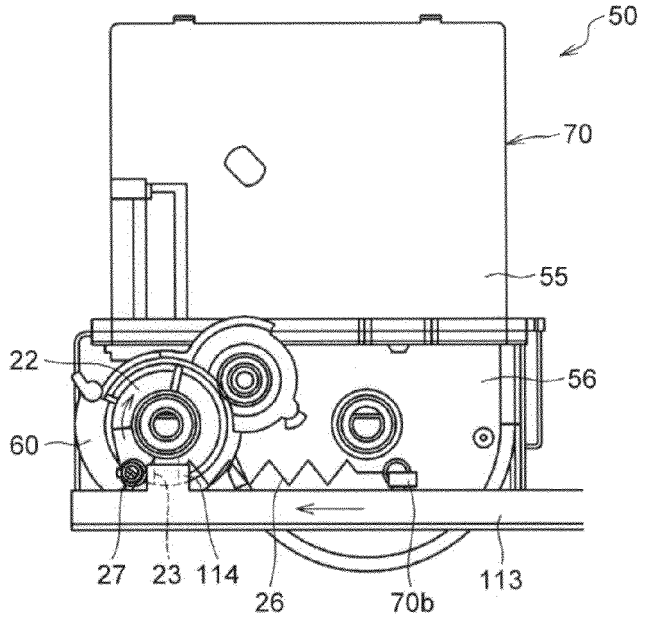
FIG. 12A is a diagram illustrating that a drive unit causes an inner shutter to enter the open state.
Figure 12B:
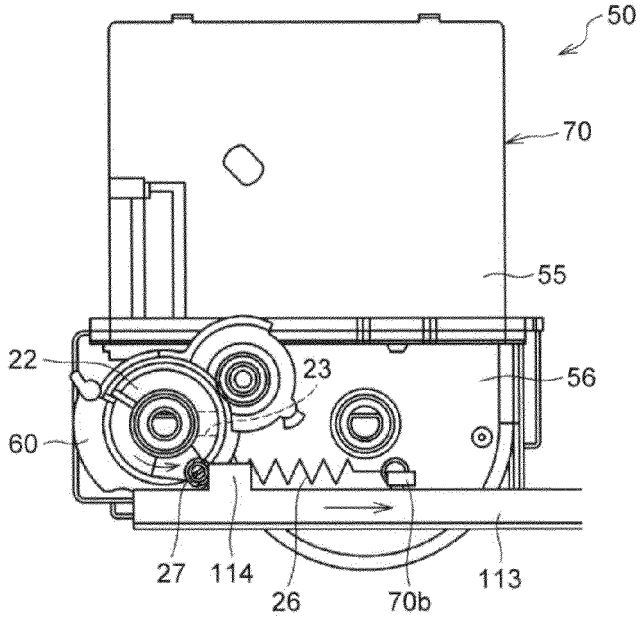
FIG. 12B is a diagram illustrating that the drive unit causes the inner shutter to enter the closed state.
Figure 13:
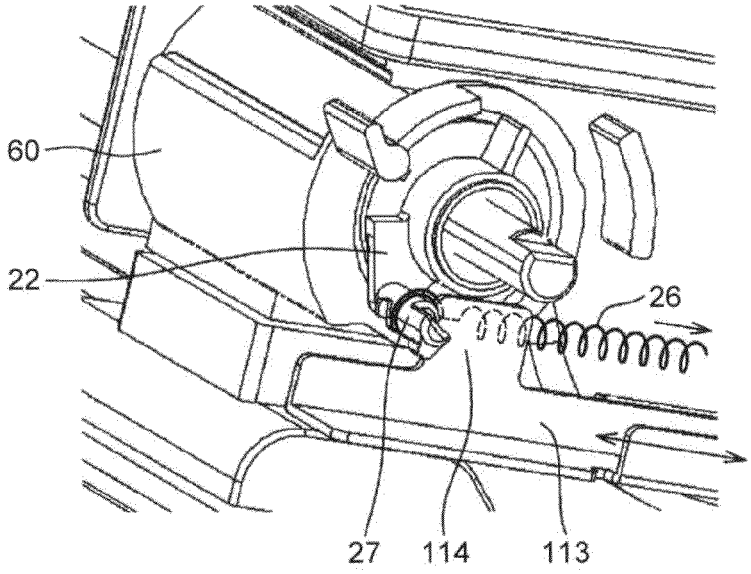
FIG. 13 is an external perspective view of the inner shutter and the drive unit.

FIG. 12A is a cross-sectional view representing that the inner shutter 22 is turned into the opened state by a drive unit, and FIG. 12B is a cross-sectional view representing that the inner shutter 22 is turned into the closed state by the drive unit. FIG. 13 is an external perspective view of the inner shutter and the drive unit. FIGS. 12A, 12B, and 13 represents the state where the gear cover 57 and each gear, such as the conveyance drive gear 62, etc. are detached from the toner cartridge 50.

A protrusion 27 is provided to an end of the inner shutter 22 exposed from the bottom case 56 and the protrusion 27 protrudes along the axial direction of the inner shutter 22. A tension spring 26 is attached between the protrusion 27 and an attachment part (not shown) provided to the side surface of the bottom case 56.

A movable member 113 is a long member that extends horizontally and is supported to be movable horizontally in the apparatus main unit 100. The movable member 113 is configured to be caused to reciprocate horizontally by a drive mechanism (not shown) provided to the apparatus main unit 100. For the drive mechanism for the movable member 113, it is preferable to use a small unit with less variation in the amount of movement, such as a solenoid or a cam mechanism. The movable member 113 is provided with protrusions 114 that can make contact with the protrusion 27 and that are equal in number to toner cartridges 50 along the longitudinal direction.

Operations for opening and closing the inner shutter 22 will be described with reference to FIGS. 12A and 12B.

As illustrated in FIG. 12A, when the movable member 113 moves leftward, the protrusion 114 of the movable member 113 pushes the protrusion 27 of the inner shutter 22 against the actuation force of the tension spring 26 so that the inner shutter 22 rotates clockwise. Accordingly, the developer outlet 23 is disposed facing down, resulting in the opened state illustrated in FIG. 11A.

On the other hand, as illustrated in FIG. 12B, when the movable member 113 moves rightward, the force to push the protrusion 27 is canceled so that the inner shutter 22 rotates counterclockwise due to the actuation force of the tension spring 26. Accordingly, the developer outlet 23 is disposed facing rightward, resulting in the closed state illustrated in FIG. 11B.

Figure 14:
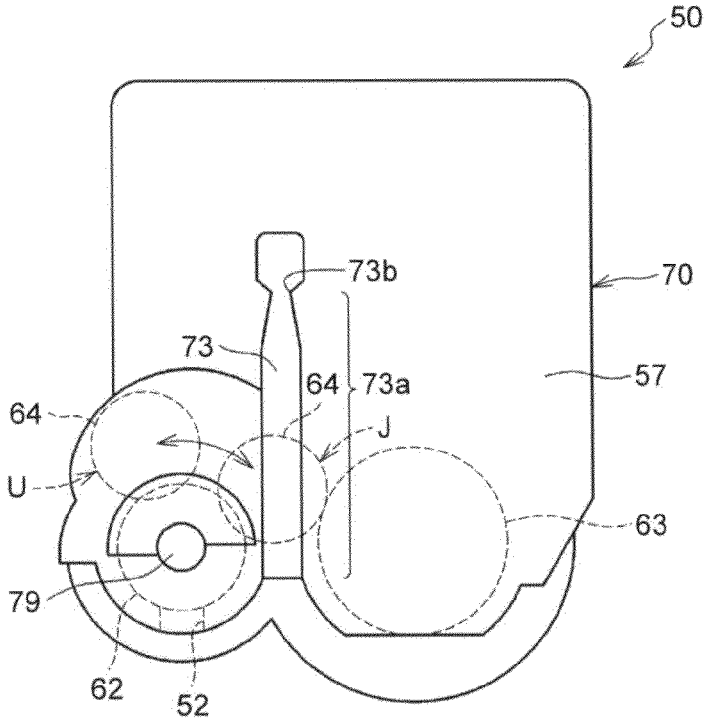
FIG. 14 is a side view of the toner cartridge viewed from the side of the gear cover.

FIG. 14 is a side view of the toner cartridge 50 viewed from the side of the gear cover 57.

As illustrated in FIG. 14, a groove 73 extending vertically is formed on the outer surface (front surface) of the gear cover 57 (see FIG. 4). The groove 73 has a function of guiding the direction in which the container body 70 is attached to/detached from the apparatus main unit 100 and a function of positioning the container body 70 with respect to the apparatus main unit 100. Specifically, a part of the groove 73 from the bottom end to a narrowed upper portion is a guiding part 73*a* with a guiding function and the narrowed part is a positioning part 73*b* with a positioning function. The bottom end of the guiding part 73*a* is open downward. The guiding part 73*a* has a uniform width, excluding the top end, and the top end gradually narrows toward the container positioning part 73*b*.

A protrusion 79 with the cylindrical peripheral surface is provided to the front side of the gear cover 57 as a different guiding and positioning parts. The protrusion 79 cooperates with guide groove 103 provided to the apparatus main unit 100 (see FIG. 17) to vertically guide the container body 70 with respect to the apparatus main unit 100 and positions the container body 70 with respect to the apparatus main unit 100. As described above, in the embodiment, positioning of the container body 70 with respect to the apparatus main unit 100 is performed in two positions: the positioning part 73*b* of the groove 73 and the protrusion 79 illustrated in FIG. 12.

A protruding positioning boss (not shown) is provided to the back surface of the gear cover 57, i.e., the back of the container positioning part 73*b* of the groove 73. When the gear cover 57 is attached to each of the cases 55 and 56, the boss is inserted into a long hole 77 (see FIG. 7, a rectangular hole) provided to the side surface of the top case 55 so that the gear cover 57 is positioned with respect to the top case 55.

On the back surface of the gear cover 57, a hole 78 (see FIG. 17) is formed coaxially with the protrusion 79. One end of the rotation shaft 530 protruding from the bottom case 56 for the conveyance screw 53 is inserted into the hole 78. The hole 78 holds the rotation shaft 530 of the conveyance screw 53 so that the gear cover 57 is positioned with respect to the bottom case 56.

FIG. 14 represents, with dotted lines, area where the gears 62, 63 and 64 are projected on the outer surface of the gear cover 57 provided with the groove 73. The area denoted by J is an area where the torque transmission gear 64 in the operation position is projected, and the area denoted by U is an area where the torque transmission gear 64 in the withdrawal position is projected. As described above, in the embodiment, a part of the guiding part 73*a* of the groove 73 is disposed in the area J where the torque transmission gear 64 in the operation position is projected. Alternatively, the whole guiding part 73*a* may be disposed in the area J where the torque transmission gear 64 in the operation position is projected. On the other hand, the narrow positioning part 73*b* of the groove 73 is required to be disposed outside the area J where the torque transmission gear 64 in the operation position is projected.

The base member 107 that is provided to the image forming apparatus main unit 100 will be described here.

Figure 15:
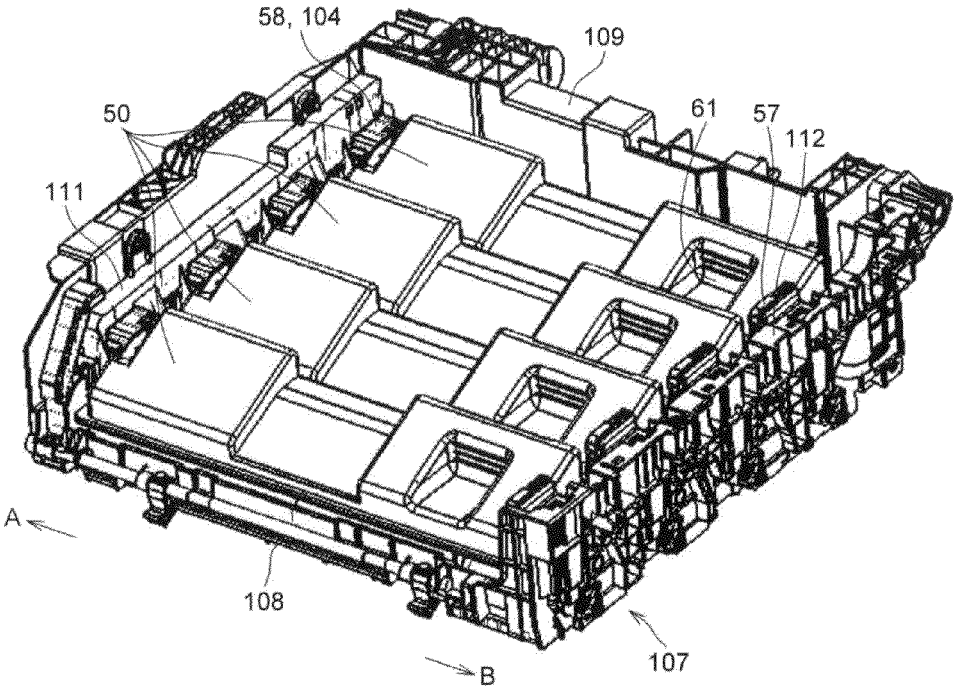
FIG. 15 is a perspective view of a base member with the toner cartridge attached thereto.

As illustrated in FIG. 15, the base member 107 includes the approximately rectangular partition 108 (see FIG. 1), a back wall 109 provided to one side of the partition 108, and a pair of side walls 111 and 112 that are provided to opposed two sides with the back wall 109 therebetween. Multiple toner cartridges 50 are disposed between the side walls 111 and 112 in parallel in a horizontal posture such that the toner cartridges are opposed to the side walls 111 and 112. The side wall that is opposed to the side surface of one end of each of the toner cartridges 50 (in the A direction: the side to which the container terminal 58 is attached) is referred to as a first side wall 111, and the side wall that is opposed to the side surface of the other end of each of the toner cartridges 50 (in the B direction: the side to which the gear cover 57 is attached) is referred to as a second side wall 112.

As illustrated in FIG. 1, the toner cartridge 50 inserted between the side walls 111 and 112 is attached to the attachment part 106 that is provided to the partition 108. The attachment parts 106 equal in number to that of the toner cartridges 50 are provided and the toner cartridges 50 are attached to the attachment parts 106, respectively, in controlled positions that are determined according to the toner colors.

Figure 16:
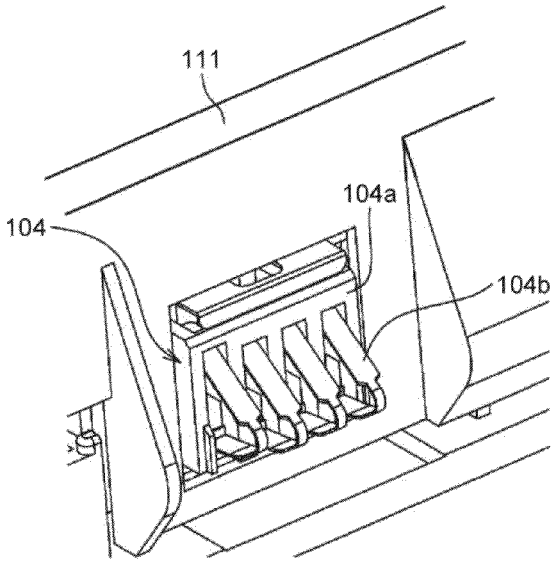
FIG. 16 is a perspective view of a first side wall that is provided with a main unit terminal.

As illustrated in FIG. 15, four main unit terminals 104 are fitted to the first side wall 111 such that the main unit terminals 104 are opposed to the container terminals 58 of the toner cartridges 50, respectively. FIG. 16 represents the configuration of the main unit terminal 104. As illustrated in FIG. 16, each of the main unit terminals 104 includes a holder 104*a* that is buried in the first side wall 111 and at least one main unit contact 104*b* that is held by the holder 104*a*. One end (e.g., the top end) of the main unit contact 104*b* is fixed to the holder 104*a* and the other end (e.g. bottom end) is free. The center part of the main unit contact 104*b* is formed to be arcuate with its protruding part on the inner side of the apparatus main unit 100. Compared to the end face of the holder 104*a*, the peak of the center part further protrudes toward the inner side of the apparatus main unit 100.

Figure 17:
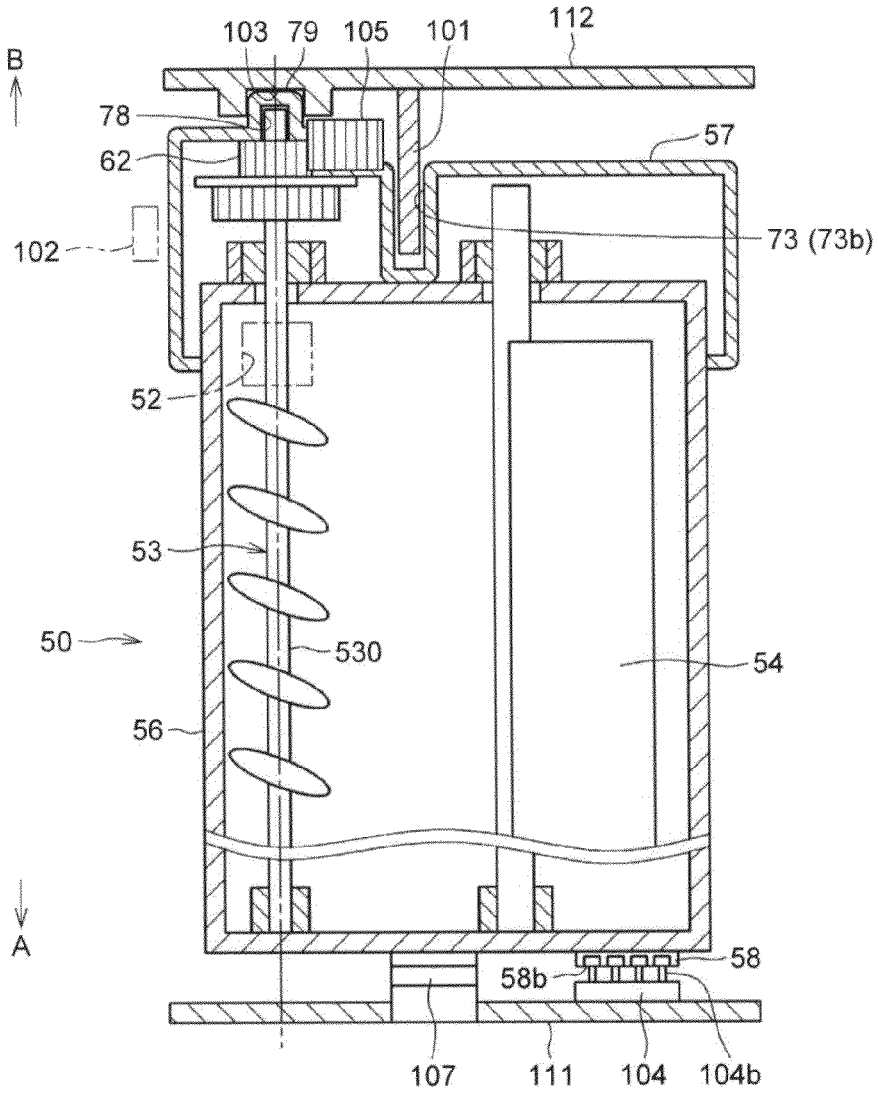
FIG. 17 is a cross-sectional view of the toner cartridge attached to the apparatus main unit, viewed from underneath.

FIG. 17 is a cross-sectional view of the toner cartridge 50 attached to the attachment part 106, viewed from underneath. As illustrated in FIG. 17, the inner surface of the second side wall 112 is provided with protrusions 101 that protrude horizontally for the respective attachment parts 106. The protrusion 101 is inserted into the groove 73 (see FIG. 14) when the toner cartridge 50 is attached to the apparatus main unit 100.

Furthermore, the guide grooves 103 are vertically provided to the inner surface of the second side wall 112 for the respective attachment parts 106. The top of each of the guide grooves 103 is open upward and, when the toner cartridge 50 is attached, the protrusion 79 (see FIG. 14) provided to the toner cartridge 50 is inserted from the opening. A receiver that receives the protrusion 79 is formed at the bottom of the guide groove 103.

The main unit drive gear 105 is provided in the vicinity of the bottom end of each of the guide grooves 103. The drive source (not shown) provided to the apparatus main unit 100 drives the main unit drive gear 105 to rotate. The main unit drive gear 105 in a state where the toner cartridge 50 is attached to the apparatus main unit 100 meshes with the conveyance drive gear 62 (see FIG. 7).

As illustrated in FIG. 17, the first side wall 111 is provided with an actuator 107 consisting of, for example, a leaf spring that actuates the toner cartridge 50 to the other side (the B direction) for each of the attachment parts 106. The actuator 107 pushes the toner cartridge 50 against the second side wall 112 and the tip of the protrusion 79 provided to the other end (in the B direction) makes contact with the bottom of the guide groove 103. This inhibits the toner cartridge 50 to move in its longitudinal direction (up-down direction in FIG. 17), which prevents the protrusion 79 from falling off the guide groove 103 and prevents the protrusion 101 from falling off the container positioning part 73*b*.

Figures 18A, 18B, 18C:
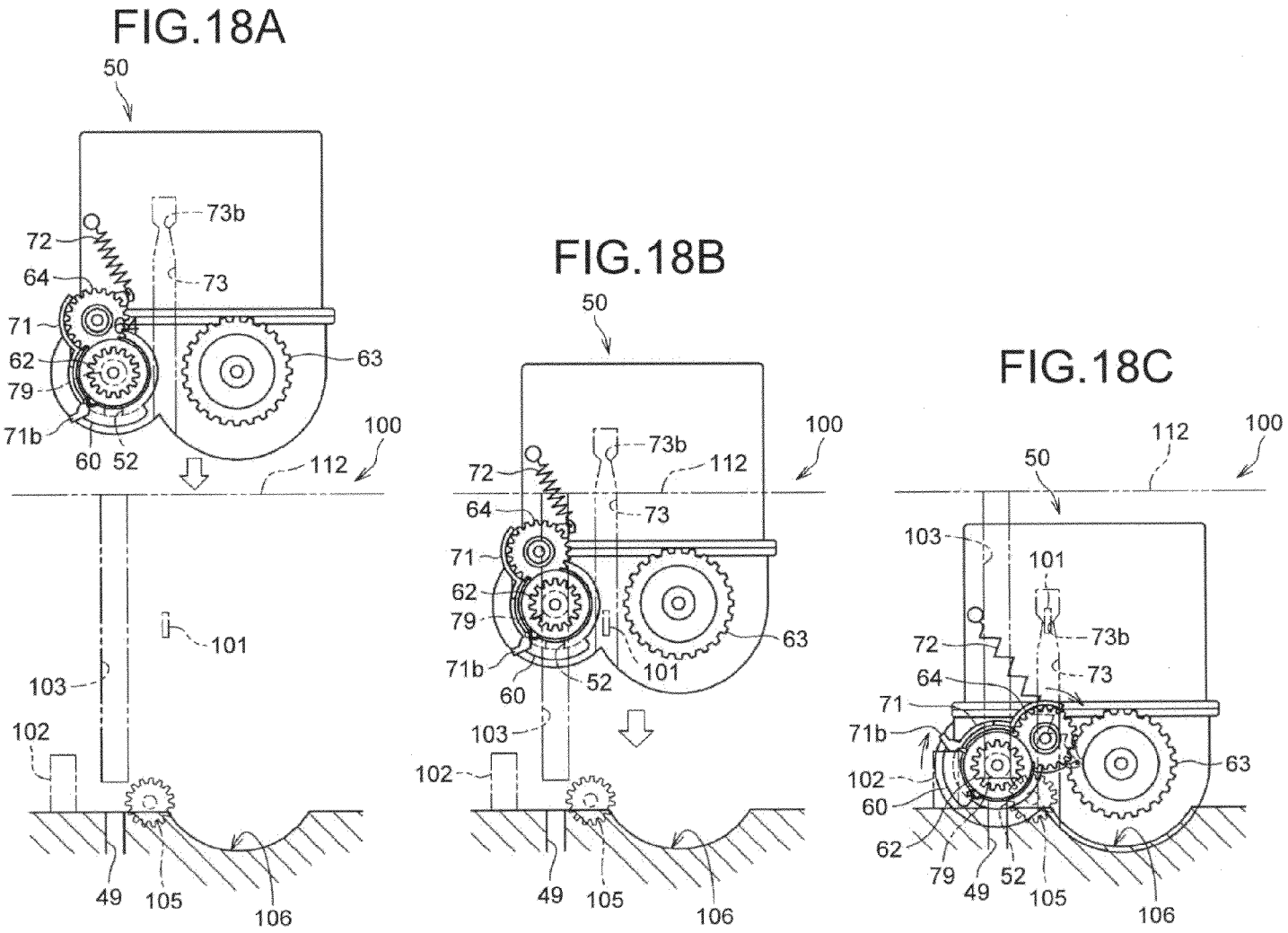
FIGS. 18A to 18C are diagrams illustrating operations for attaching and detaching the toner cartridge to and from the apparatus main unit.

With reference to FIGS. 18A to 18C, attachment of the toner cartridge 50 to the apparatus main unit 100 and detachment of the toner cartridge 50 from the apparatus main unit 100 according to the embodiment will be described here.

When attaching the toner cartridge 50 to the apparatus main unit 100, a user puts the top cover 109 (see FIG. 1) of the apparatus main unit 100 into the opened state represented by the two-dot chain lines. Subsequently, the user performs an operation for attachment of the toner cartridge 50. The attachment operation is performed in a way that, as illustrated in FIG. 18A, the user grips the grip 61 and moves down the toner cartridge 50 via the top opening of the apparatus main unit 100.

In accordance with the attachment operation, as illustrated in FIG. 18B, the protrusion 79 provided to the toner cartridge 50 is inserted into the top end of the guide groove 103 of the second side wall 112. Because the guide groove 103 guides the direction in which the toner cartridge 50 is inserted during the attachment operation, the toner cartridge 50 can be guided to the attachment part 106 smoothly.

As illustrated in FIG. 18C, once the state where the toner cartridge 50 is attached to the attachment part 106, the protrusion 79 of the toner cartridge 50 makes contact with the bottom end (receiver) of the guide groove 103 so that the toner cartridge 50 is positioned.

In accordance with the operation for attachment of the toner cartridge 50, the protrusion 101 provided to the second side wall 112 is inserted into the groove 73. As illustrated in FIG. 18C, when the toner cartridge 50 is attached to the attachment part 106, a protrusion 101 is positioned in the narrowed container positioning part 73*b*.

During the attachment operation, the shutter control member 102 provided to the apparatus main unit 100 further makes contact with the operation part 71*b* of the gear holder 71. This causes the gear holder 71 to turn in the direction denoted by the arrow shown in FIG. 18C against the tension (actuation force) of the tension spring 72 and be disposed in the operation position where the torque transmission gear 64 meshes with the stirring drive gear 63. Furthermore, the turn of the gear holder 71 causes the outer shutter 60, which is provided integrally with the gear holder 71, to turn and enter the state where the periphery of the discharge port 52 is open. The inner shutter 22 is kept closed even in this state (when the toner cartridge 50 is mounted on the main unit). There is a moment when the discharge port 52 of the toner cartridge 50 is disconnected to the supply port 49 of the main unit during a series of operations for opening the outer shutter 60. In this moment, the toner leaks downward but does not leak out because the inner shutter 22 is kept closed.

When the torque transmission gear 64 moves close to the groove 73 to move to the operation position, the protrusion 101 has already passed the area overlapping the operation position on the groove 73, which prevents the torque transmission gear 64 and the protrusion 101 from interfering with each other.

When the torque transmission gear 64 moves to the operation position and meshes with the stirring drive gear 63, the conveyance screw 53 and the agitator 54 in the toner cartridge 50 are interconnected and operate cooperatively. Simultaneously, the outer shutter 60 integrally provided to the gear holder 71 turns from the position represented in FIG. 18B to the position represented in FIG. 18C and enters the state where the discharge port 52 is open. The open discharge port 52 is then interconnected to the supply port 49 of the apparatus main unit 100.

The inner shutter 22 then enters the opened state. Specifically, closure of the top cover 109 triggers the movable member drive unit, such as a solenoid or a cam, to operate the movable member 113. In other words, as illustrated in FIGS. 12A and 12B, for example, when the printer is turned on, the movable member 113 moves to the left in FIG. 12A so that the inner shutter 22 enters the opened state. Accordingly, the outer and inner shutters 22 and 60 are opened such that toner can be discharged from the discharge port 52.

In the state where the toner cartridge 50 is attached to the attachment part 106, the conveyance drive gear 62 meshes with the main unit drive gear 105. In this state, when the main unit drive gear 105 is driven to rotate by the drive source (not shown), the drive force is transmitted to the conveyance screw 53 and the agitator 54 via the conveyance drive gear 62, the torque transmission gear 64, and the stirring drive gear 63 so that the conveyance screw 53 and the agitator 54 are driven to rotate. Accordingly, toner is supplied to the developing device from the discharge port 52 via the supply port 49.

To detach the toner cartridge 50 from the apparatus main unit, first, the top cover 109 is opened (see FIG. 1). In accordance with this operation, the above-described movable member drive unit operates and, as illustrated in FIG. 12B, the movable member 113 moves to the right in FIG. 12B so that the inner shutter 22 enters the closed state. The user then performs an operation for detaching the toner cartridge 50. The detachment operation is performed in a way that the user grips the grip 61 and moves up the toner cartridge 50 positioned at the attachment part 106 to take out the toner cartridge 50 from the top opening of the apparatus main unit 100.

As illustrated in FIG. 18B, when the toner cartridge 50 is pulled up, the contact of the shutter control member 102 of the apparatus main unit 100 with the operation part 71*b* of the gear holder 71 is canceled and the gear holder 71 is rotated with a tension force (actuation force) of the tension spring 72 to be returned to the original position. In accordance with the rotation of the gear holder 71, the torque transmission gear 64 is disposed in the withdrawal position apart from the stirring drive gear 63. The protrusion 101 passes the area overlapping the operation position on the groove 73, but the torque transmission gear 64 will have already withdrawn from the groove 73 when the protrusion 101 reaches the area and thus the protrusion 101 and the torque transmission gear 64 do not interfere with each other.

As illustrated in FIG. 18B, when the gear holder 71 rotates to the original position, the outer shutter 60 rotates accordingly so that the discharge port 52 is closed. Accordingly, the inner shutter 22 that tends to be soiled due to its connection with the supply port 49 is further covered with the outer shutter 60. This reduces the risk that the user's hand is stained when touching the shutter. Because both of the inner and outer shutters 22 and 60 are kept closed, prevention of toner from scattering from the discharge port 52 improves greatly.

With this configuration, in the state where the toner cartridge 50 has been detached, the interconnection between the conveyance screw 53 and the agitator 54 in the toner cartridge 50 is canceled. Thus, even if the user touches the gear 62 or the gear 64 by accident so that one of the conveyance screw 53 and the agitator 54 is driven, the drive force is not transmitted to the other. This reduces the load to the developer applied when both the conveyance screw 53 and the agitator 54 are driven, which reduces degradation of the developer and prevents the conveyance screw 53 and the agitator 54 from being broken.

Because the return port 24 is provided, even if the user drives the conveyance screw 53, the developer can be returned to the developer storage unit 51 from the return port 24. This reduces the load applied to the developer.

With the above-described configuration, because the inner shutter 22 enters the opened state when attachment of the toner cartridge 50 completes, the toner can be prevented from scattering from the toner cartridge 50. In other words, while the outer shutter 60 opens first in accordance with the attachment operation when the toner cartridge 50 is attached, the inner shutter 22 still closes, which prevents the toner inside from scattering before the discharge port 52 is connected to the supply port 49. The outer shutter 60 is opened before the attachment of the toner cartridge 50 completes for the purpose of preventing the interference with the supply port 49.

To detach the toner cartridge 50, first, the inner shutter 22 is closed in the attached state. Because the outer shutter 60 closes in accordance with the detachment operation, even if the toner is attached to the inner side of the discharge port 52, the toner is not scattered. According to the embodiment, the two-shutter structure with the inner shutter 22 and the outer shutter 60 assuredly prevents toner from scattering from the discharge port 52 when the toner cartridge 50 is detached.

Furthermore, according to the embodiment, because the outer shutter 60 automatically closes the discharge port 52 in accordance with the detachment operation when the toner cartridge 50 is detached, the toner can be prevented from leaking or scattering from the discharge port 52 when the outer shutter 60 is left opened.

A characteristic configuration of the embodiment will be described below.

Figure 19:
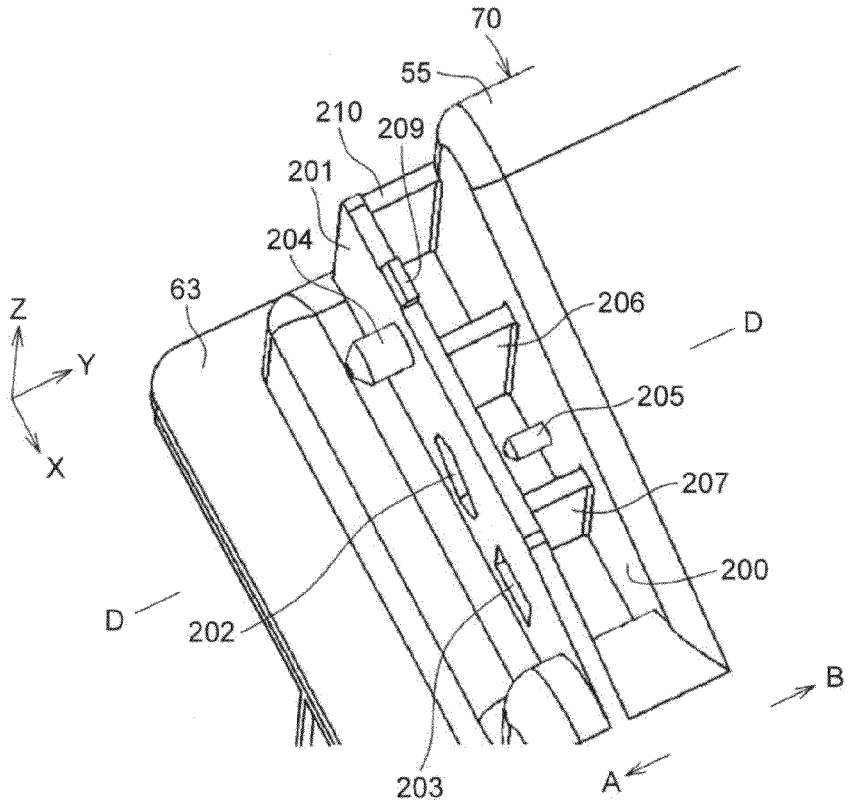
FIG. 19 is a perspective view of the side of one end of a container body.
Figure 20:
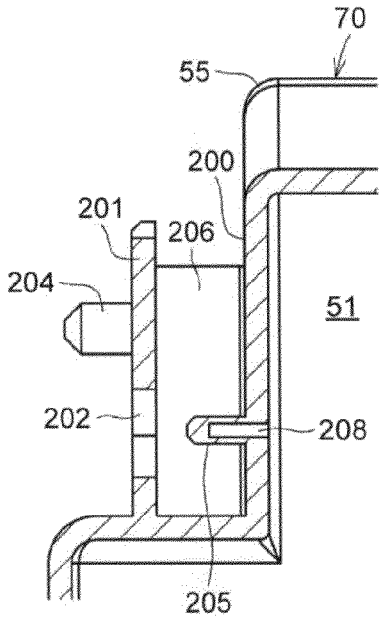
FIG. 20 is a cross-sectional view of the side of one end of the container body taken along the line D-D in FIG. 19 along the Y-Z plane.

FIG. 19 is a top perspective view of one end of the container body 70 on one side (in the A direction) from which the container terminal 58 has been detached. FIG. 20 is a cross-sectional view of FIG. 19, taken along the Y-Z plane including the line D-D. As illustrated in FIGS. 19 and 20, the upper corner of the top cover 55 that constitutes the container body 70 on one side has a double-wall structure including an inner wall 200 and an outer wall 201 integrally.

As illustrated in FIG. 19, a first through hole 202 and a second through hole 203 are formed apart from each other in the short-length direction of the container body 70 (in the X-direction in FIG. 19). The outer end surface of the outer wall 201 is provided with a protruding positioning pin 204 for positioning the container terminal 58. On the other hand, on the inner wall 200, a protrusion 205 is integrally formed that is opposed to the first through hole 202 of the outer wall 201 and that protrudes to one end of the container body 70 in the longitudinal direction (in the A direction). The top of the space between the inner wall 200 and the outer wall 201 is open and, from among the space, the area around the protrusion 205 is partitioned with respect to other areas by two ribs 206 and 207 that are disposed separately in the short-length direction of the container body 70. An engagement protrusion 209 is formed on the top surface of the outer wall 201.

As illustrated in FIG. 20, the inner space of the inner wall 200 constitutes the developer storage unit 51 that stores toner. The protrusion 205 provided to the inner wall 200 is formed to be hollow with a blind hole 208. The blind hole 208 extends in the longitudinal direction of the container body 70, and one end of the blind hole 208 is open to the developer storage unit 51 and the other end is in a position at least over the outer end surface of the inner wall 200. The blind hole 208 serves as a flow preparation part for forming an airflow hole 211 when the container terminal 58 is detached from the container body 70, which will be described below.

Each unit (the inner wall 200, the outer wall 201, the first through hole 202, the second through hole 203, the positioning pin 204, the protrusion 205, the ribs 206 and 207, the blind hole 208, etc.) of the double wall part of the top case 55 is formed integrally with the top case 55 by resin injection molding etc.

Figure 21:
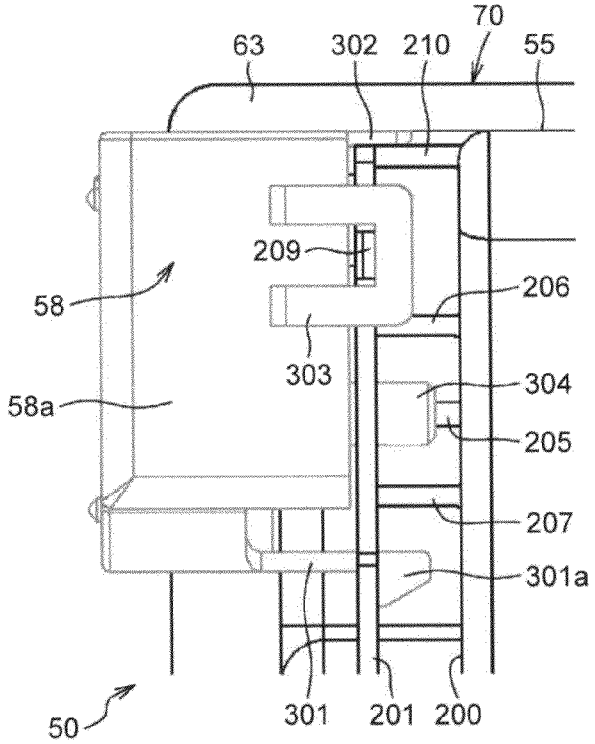
FIG. 21 is a plane view of the container body to which container terminal is attached.

FIG. 21 is a plane view illustrating the state where the container terminal 58 (indicated by gray) is attached to the end of the container body 70 on one side in the longitudinal direction.

As illustrated in FIGS. 5 and 21, both ends of the holder 58*a* of the container terminal 58 in the short-length direction of the container body 70 in the X direction in FIG. 19 are provided with a first arm 301 and a second arm 302 that protrude to the side of the other end of the container body 70 in the longitudinal direction. The first arm 301 has a wide claw 301*a* on its tip. On the top surface of the holder 58*a*, a lock part 303 that is U-shaped in a plane view is formed. The back surface of the holder 58*a* is provided with an engagement part 304 that protrudes to the side of the other end in the longitudinal direction of the container body 70. A hole (not shown) that fits the protrusion 205 is formed in the engagement part 304. The first arm 301, the second arm 302, and the lock part 303 are formed integrally with the holder 58*a* by resin injection molding etc.

The container terminal 58 is attached to the container body 70 by pushing the container terminal 58 against the side of the other end of the container body 70 in its longitudinal direction. In accordance with the insertion, the positioning pin 204 is inserted into the positioning hole (not shown) that is provided to the back surface of the holder 58*a* and the protrusion 205 provided to the inner wall 200 is inserted into the hole that is formed in the engagement part 304 of the holder 58*a*. The claw 301*a* that is provided to the first arm 301 of the holder 58*a* interferes with the outer wall 201 and the first arm 301 passes the second through hole 203 while elastically deforming (see FIG. 19). Furthermore, the lock part 303 passes over the engagement protrusion 209 of the outer wall 201 while elastically deforming and the second arm 302 of the holder 58*a* engages with the side wall 210 of the double wall part of the container body 70.

Once the container terminal 58 is pushed into a specified position, the first arm 301 elastically returns and the claw 301*a* engages with the periphery of the second through hole 203 and the engagement protrusion 209 elastically returns and engages with the lock part 303. Accordingly, the container terminal 58 is prevented from slipping off due to the pulling force to the side of one end of the container body 70 in the longitudinal direction and the container terminal 58 is fixed to the container body 70.

When a new toner cartridge 50 is manufactured, normally, the container body 70 is filled with toner before the container terminal 58 is attached to the container body 70. This is to prevent the container terminal 58 from being stained due to scattering of toner. After the filling with toner, the cap member 59 (see FIG. 3) is attached to the filling port to seal the filling port and then the container terminal 58 is attached to the container body 70 according to the above-described procedure so that a new toner cartridge 50 is completed.

Figure 22:
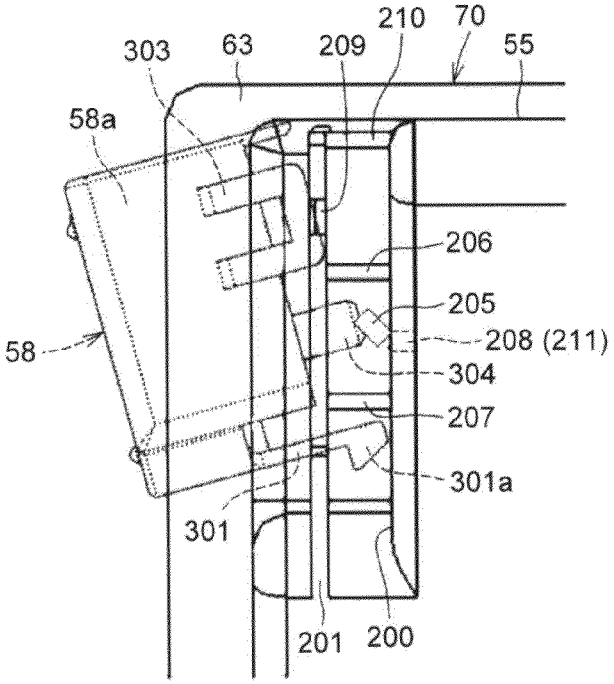
FIG. 22 is a plane view illustrating an operation of detaching the container terminal.

To reuse the toner cartridge 50, first, the container terminal 58 is detached. For the detachment, because the claw 301*a* and the lock part 303 are engaged with the outer wall 201, the container terminal 58 cannot be pulled off to the side of one end of the container body 70 in the longitudinal direction. For this reason, as indicated by the dotted line in FIG. 22, the container terminal 58 is turned (rotated) to cancel the engagement of the claw 301*a* and the lock part 303 with the outer wall 201 and then the container terminal 58 is detached. FIG. 22 illustrates the case where the container terminal 58 is detached while being rotated about the rotation axis in the Z-axis direction in FIG. 19.

Detachment of the container terminal 58 while turning it causes a stress concentration on the base of the protrusion 205 being engaged with the engagement part 304 of the holder 58*a*. Thus, the base of the protrusion 205 ruptures and the protrusion 205 is separated from the container body 70. Accordingly, both ends of the blind hole 208 are open and the airflow hole 211 that allows communications between the inside and outside of the container body 70.

Figure 23:
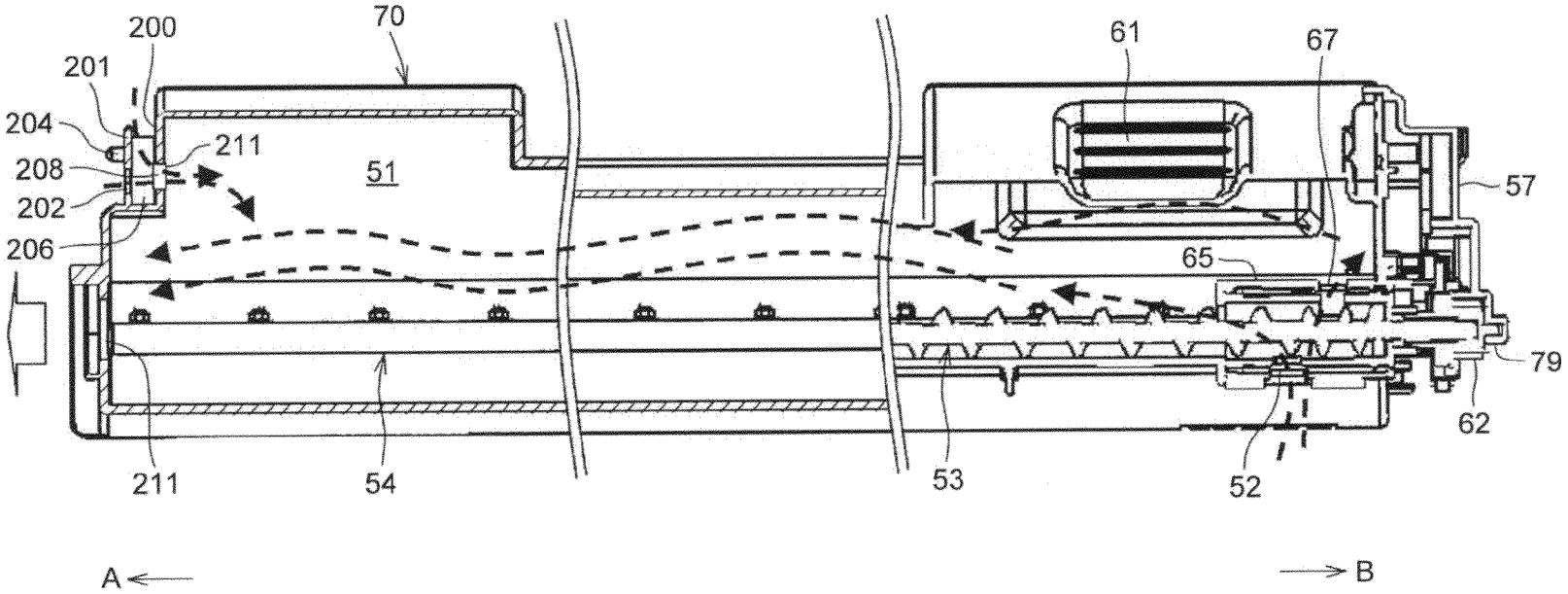
FIG. 23 is a longitudinal cross-sectional view of the toner cartridge from which the container terminal is detached.

The cap member 59 is detached to open the filling port and a nozzle is inserted into the filling port to introduce the air. Because the air flows into from the airflow hole 211, the residual toner in the developer storage unit 51 can be sucked assuredly. Here, the shutter 60 is opened to let the discharge port 52 open, which increases the number of spots where the air flows into the developer storage unit 51. This leads to, as illustrated in FIG. 23, various and active air flows (denoted by the dotted lines) in the developer storage unit 51, which further increases the sucking efficiency (the shutter 60 is not shown in FIG. 23).

After cleaning of the inside of the container body 70 completes, the shutter 60 is closed to close the discharge port 52 and the container body 70 is refilled with toner. The airflow hole 211 is closed with an appropriate closing member, the filling port is sealed with the cap member 59, and the container terminal 58 is attached to the container body 70 so that a re-use product of the toner cartridge 50 is completed. For the closure member, a member manufactured to be fitted to the airflow hole 211, an adhesive, a tape, etc. may be used. The word "reuse" here means that the same container body 70 is filled with toner again. Reuse of the toner cartridge 50 refers to, in addition to use of the toner cartridge 50 that is collected from the user after toner is consumed, a case where, when a defective toner cartridge 50 is detected during finished product inspection, the toner in the container body 70 is disposed and the same container body 70 is filled with toner.

According to the embodiment, as described above, the container body 70 is provided with the protrusion 205 that is engaged with the container terminal 58 in a normal state and changes its form (separates from the container body in the embodiment) due to an external force that is applied when the container terminal 58 is detached from the container body 70. The container body 70 is further provided with the blind hole 208 that completely separates the inside and outside of the container body 70 before the separation of the protrusion 205 and that, after the separation, allows air flow between the inside and outside of the container body 70. When the protrusion 205 is ruptured and separated from the container body 70, the blind hole 208 forms the airflow hole 211 that allow air flow between the inside and outside of the container body 70. This allows active air flow in the container body 70 such that the residual toner in the container body 70 can be efficiently collected. By determining whether there is the protrusion 205, it is possible to check by sight whether the toner cartridge 50 is a new one or a reused one. If it is determined that the toner cartridge 50 is a reused one, it can be determined that reusing the toner cartridge 50 is prohibited and the toner cartridge 50 is disposed. Accordingly, the embodiment provides both cleaning efficiency and easy check on a history when the toner cartridge 50 is reused.

As illustrated in FIG. 19, the ribs 206 and 207 and the outer wall 201 are disposed around the protrusion 205 so that the ribs 206 and 207 serve as an inhibition wall that inhibits the user's hand or finger from touching the protrusion. Accordingly, it can be prevented that the user's hand or finger touches the protrusion 205 unintentionally and thus the protrusion 205 is broken.

The resin-formed part that is formed integrally with the inner wall 200 is illustrated as an example of the protrusion 205 that is formed in the inner wall 200 of the container body 70. Alternatively, the protrusion 205 may be formed by attaching another member to the inner wall 200. In this case, it is desirable that the protrusion 205 be assuredly detached from the inner wall by an external force that is applied to detach the container terminal 58. For example, if any one of the protrusion 205 and the inner wall 200 is made of metal, it is considered to fix the protrusion 205 and the inner wall 200 by thermal caulking. In this case, because the joint made by thermal caulking is a vulnerable part, the protrusion 205 is separated from the inner wall 200 in accordance with detachment of the container terminal 58 and, with the hole that is formed after the separation, the airflow hole 211 can be formed.

According to the embodiment, the male part (the protrusion 205) is provided to the inner wall 200 and the female part (the engagement part 304) is provided to the container terminal 58 and the protrusion 205 and the engagement part 304 are engaged with each other. Alternatively, in contrast to this, a male part may be provided to the container terminal 58 and a female part may be provided to the inner wall 200 (a second embodiment). The protrusion 205 serves as an identifier, the change of the form of which can be identified from the outside. For the change of the form of the identifier, a configuration in which the identifier is deformed may be employed instead of the above-described configuration in which the identifier is separated. For example, any one of the male and female parts is made stiff and the other is made vulnerable such that the vulnerable part is deformed with an external force applied to detach the container terminal 58. It is possible also in this case to check whether the toner cartridge 50 is a new or reused one, which leads to the same effect.

FIGS. 24 to 27 illustrates the configuration of the image forming apparatus according to another embodiment of the present invention. With reference to FIGS. 24 to 27, the difference from the above-described embodiment will be described below.

Figure 24:
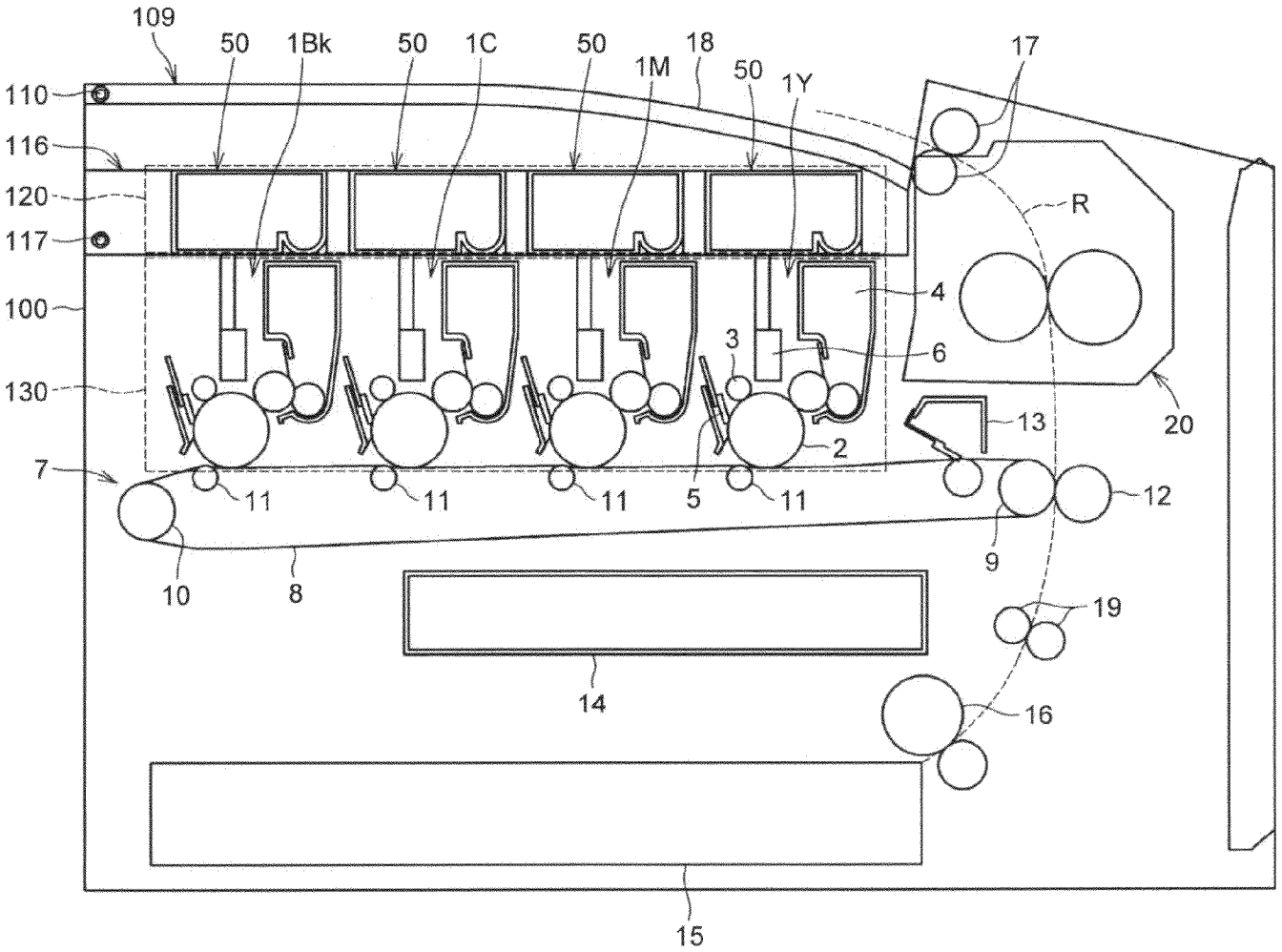
FIG. 24 is a schematic configuration diagram of an image forming apparatus according to another embodiment of the present invention.
Figure 25:
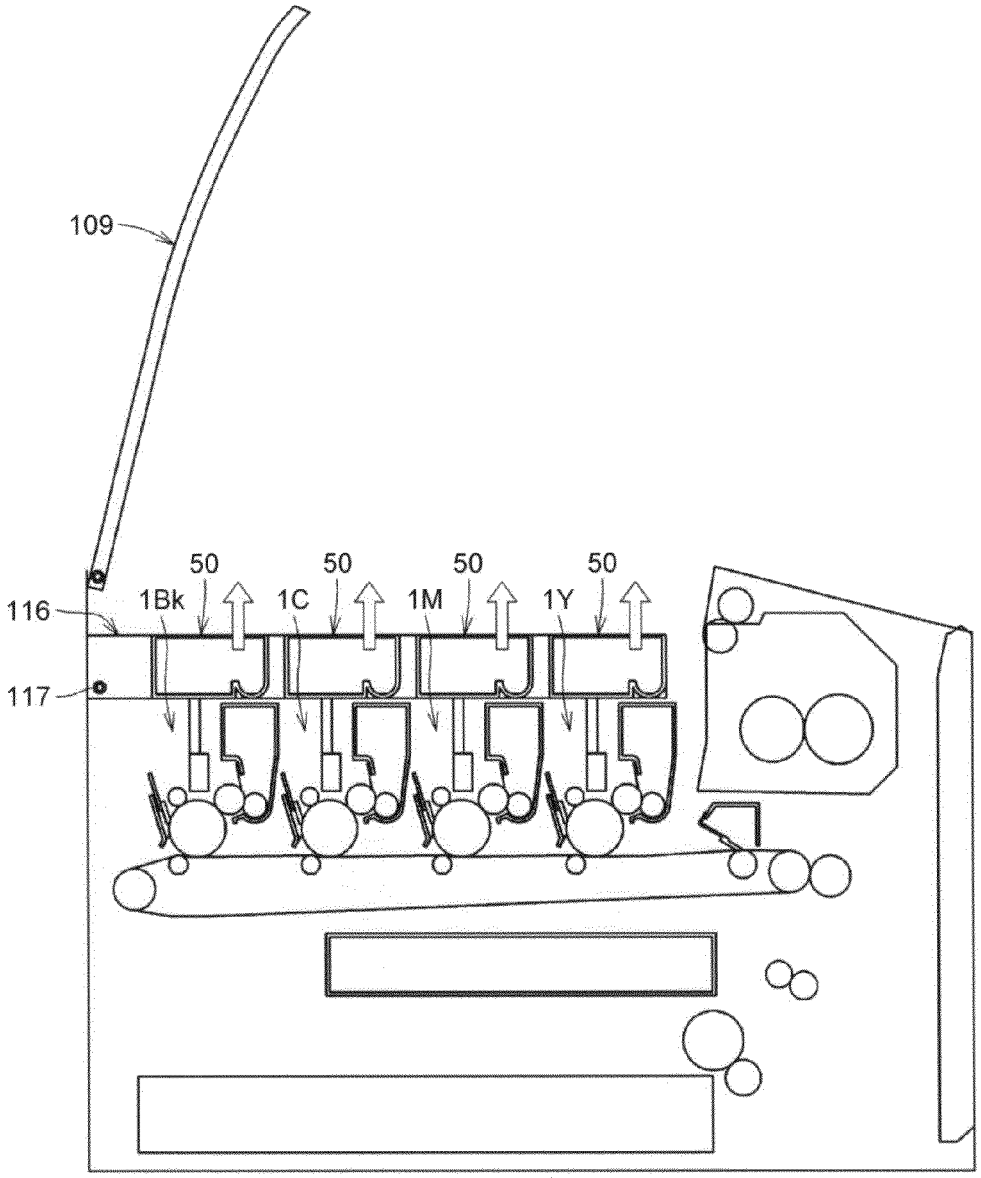
FIG. 25 is a diagram indicating a state where a top cover is opened.
Figure 26:
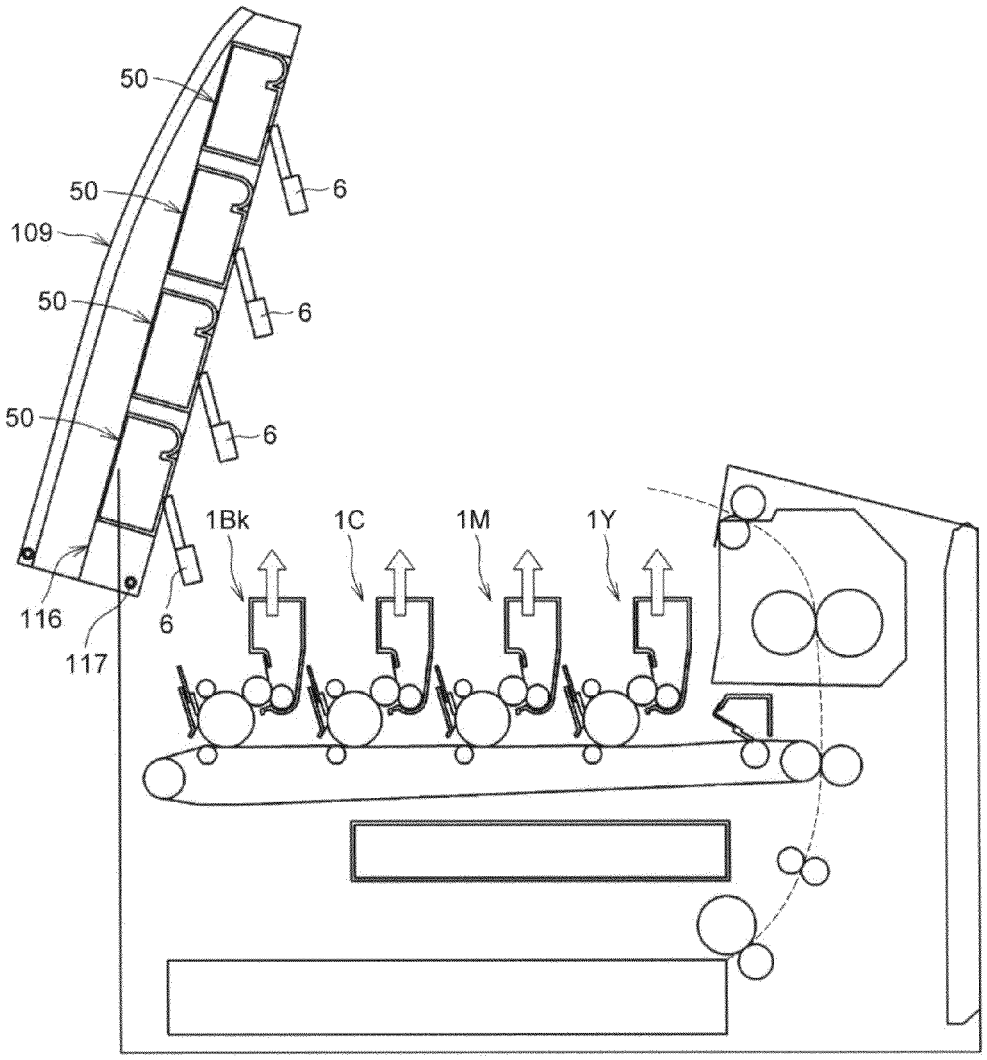
FIG. 26 is a diagram indicating a state where the top cover and an inner cover are opened.

As illustrated in FIG. 24, the image forming apparatus includes the top cover 109 serving as a first cover provided to the top of the apparatus main unit 100, a container attachment part 120 to/from which the toner cartridge 50 can be attached/detached when the top cover 109 is opened, an inner cover 116 serving as a second cover that is provided to be openable/closable to the image forming apparatus main unit on the inner side with respect to the container attachment part 120, and a unit attachment part 130 to/from which the processing units 1Y, 1M, 1C, and 1Bk can be attached/detached when the inner cover 116 is opened. FIG. 25 illustrates a state where the top cover 109 is opened and FIG. 26 illustrates a state where the inner cover 116 is opened.

Specifically, the inner cover 116 is attached to the apparatus main unit 100 such that the inner cover 116 can turn about a fulcrum 117 to be opened upward/closed downward. The toner cartridge 50 that stores toner of each color can be attached to the top of the inner cover 116. Although it is not illustrated, as in the case of the above-describe embodiment, multiple attachment parts 106 (see FIG. 15) are formed for attaching the toner cartridges 50, respectively. As illustrated in FIG. 25, the toner cartridge 50 can be attached/detached with the top cover opened.

The processing units 1Y, 1M, 1C and 1Bk are housed in the inner side with respect to (under) the inner cover 116. Thus, to attach/detach the processing units 1Y, 1M, 1C and 1Bk, both the top cover 109 and the inner cover 116 are kept open as illustrated in FIG. 26. The exposure devices (LED units) 6 that expose the photosensitive elements 2, respectively, are swingably attached to the bottom surface of the inner cover 116. In accordance with the opening/closing operation of the inner cover 116, each of the exposure devices 6 moves between the position where the exposure device 6 is close to the photosensitive element 2 and the position to which the exposure device 6 withdraws from the position close to the photosensitive element 2 while a guide unit (not shown) lets the exposure devices 6 to avoid interfering with the processing units 1Y, 1M, 1C, and 1Bk.

The above-described configuration allows, when the inner cover 116 opens, withdrawal from the area above the processing units with the toner cartridges being attached, which allows attachment of the processing units without detaching the toner cartridges. This improves operability during the operation of replacing the processing units and reduces the risk that toner is scattered from the toner cartridges into the apparatus.

In contrast, because it is not possible to check the processing units by sight when the inner cover 116 is kept closed, there is a risk that, when processing units of multiple colors are replaced once, the top cover 109 and the inner cover 116 are closed with the processing units left detached partly. In case a processing unit is left detached and the discharge port 52 corresponding to the processing unit left detached is opened, toner is scattered into the apparatus.

Figure 27:
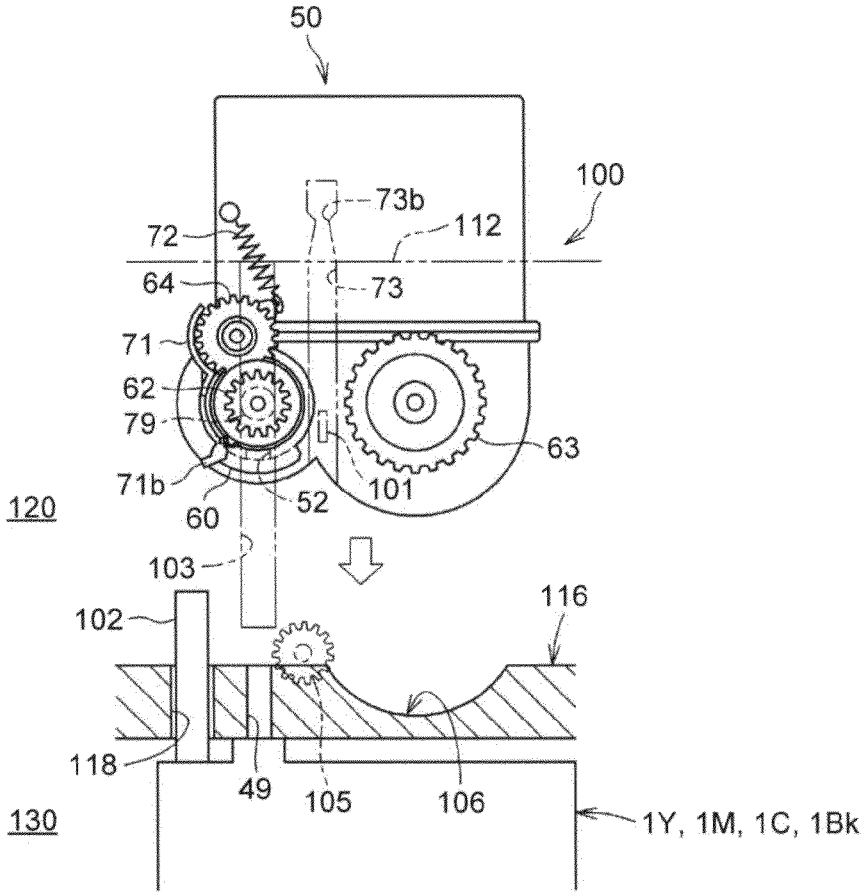
FIG. 27 is a diagram of a configuration where a processing unit is provided with an abutment part.

In order to prevent such toner scattering, each of the processing units 1Y, 1M, 1C, and 1Bk is provided with the shutter control members 102 for opening the outer shutter 60 as illustrated in FIG. 27. In accordance with this, an insertion hole 118 into and through which the shutter control member 102 is inserted and penetrates is provided is formed in the inner cover 116. Accordingly, when the processing units 1Y, 1M, 1C, and 1Bk are attached and the inner cover 116 is closed, the shutter control members 102 are inserted into and penetrates through the insertion holes 118 of the inner cover 116 so that the shutter control members 102 protrudes to the inside of the container attachment part 120.

With the above-described configuration, in a part where a processing unit is not attached, the shutter control member 102 for opening the outer shutter 60 does not exist and thus the outer shutter 60 does not open. Accordingly, even if the inner cover 116 is closed while a processing unit is left detached, the outer shutter 60 does not open in the place where the processing unit is not attached, which prevents the toner from scattering.

Another embodiment has been described with reference to FIGS. 24 to 27 and the same components as those of the above-described embodiment leads to the same functions and effects.

The present invention is not limited to the above-described embodiments. Needless to say, various modifications may be made to the number, shape, arrangement of components, etc. within the scope of the present invention.

In the embodiments, the toner is used as the developer. However, the developer is not limited thereto and a premixed toner in which carrier is mixed into toner may be used.

To reuse the developer container, the container terminal is detached from the container terminal. According to the embodiment, the identifier changes its form due to an external force applied for the detachment, the flow preparation part enters a communicable state and allows the air to flow between the inside and the outside of the container body. This allows, when the residual developer is sucked from the filling port, the air to flow into the container body and leads to active air flow in the container body, which makes it possible to efficiently collect the residual developer. Furthermore, it can be checked whether the developer container is a new or reused one depending on whether the identifier changes the form. This leads to both cleaning efficiency and easy check on a history when the developer container is reused.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A container, comprising:

a container body to store toner and includes a filling port for the toner; and a container terminal that is attachable to and detachable from the container body and is electrically connectable to a terminal of an image forming apparatus, wherein:

the container is attachable to and detachable from the image forming apparatus and, when attached to the image forming apparatus, is electrically connected to the terminal of the image forming apparatus, and the container body includes an identifier that engages with the container terminal, the identifier having a physical form which is permanently changed by an external force that is applied to detach the container terminal from the container body.

2. The container according to claim 1, wherein the identifier includes a protrusion that protrudes from the container body and is to be broken by the external force.

3. The container according to claim 2, further comprising:

a hole in the container body that is different from the filling port, the hole being disposed at a position that corresponds to a position of the identifier, the hole being blocked by the identifier prior to the identifier having the physical form which is permanently changed.

4. The container according to claim 2, wherein an inhibition wall that inhibits a hand or a finger from touching the protrusion is disposed around the protrusion.

5. The container according to claim 1, wherein the identifier is fixed to the container body by thermal caulking.

6. The container according to claim 1, further comprising:

a discharge port to discharge the toner from the container body; and a shutter that opens the discharge port in accordance with an attachment operation and closes the discharge port in accordance with a detachment operation.

7. A developing device comprising:

a development housing to store a developer;

a developer carrier to carry the developer in the developer housing and supply the developer to a latent image on a latent image carrier; and the container to supply the developer which includes the toner to the developer housing according to claim 1.

8. A processing unit comprising:

a latent image carrier to carry a latent image on a surface of the latent image carrier; and the developing device according to claim 7.

9. An image forming apparatus comprising the container according to claim 1.

10. The container according to claim 1, wherein the container body includes developer therein which includes the toner.

11. A method of manufacturing a container including: a container body to store toner and includes a filling port for the toner; and a container terminal that is attachable to and detachable from the container body and is electrically connectable to a terminal of an image forming apparatus, the container being attachable to and detachable from the image forming apparatus and, when attached to the image forming apparatus, being electrically connected to the terminal of the image forming apparatus, the method comprising:

permanently changing a physical form of an identifier of the container body which engages with the container terminal with an external force that is applied to detach the container terminal from the container body;

providing the container body with an airflow hole that allows the air to flow between an inside and outside of the container body after the permanent changing of the physical form of the identifier;

sucking residual toner in the container body from the filling port of the container body after the providing; and filling the container body via the filling port after the sucking.

12. The method according to claim 11, wherein:

the identifier includes a protrusion that protrudes from the container body, and the permanent changing includes breaking the protrusion by the external force.

13. The method according to claim 12 wherein:

the container body includes a hole in the container body that is different from the filling port, the hole being disposed at a position that corresponds to a position of the identifier, the hole being blocked by the identifier prior to the identifier having the physical form which is permanently changed and the permanently changing the physical form of the identifier of the container body causes removal of the identifier from blocking the hole in the container body.

14. The method according to claim 12, wherein:

an inhibition wall that inhibits a hand or a finger from touching the protrusion is disposed around the protrusion.

15. A container, comprising:

a container body to store toner and includes a filling port for the toner; and a container terminal that is attachable to and detachable from the container body and is electrically connectable to a terminal of an image forming apparatus, wherein:

the container is attachable to and detachable from the image forming apparatus and, when attached to the image forming apparatus, is electrically connected to the terminal of the image forming apparatus, the container body includes an identifier that engages with the container terminal, the identifier having a form which is changed by an external force that is applied to detach the container terminal from the container body, and the container body includes a part that separates an inside and outside of the container body before changing the form of the identifier and allows the air to flow between the inside and outside of the container body after changing the form of the identifier, wherein the identifier includes a protrusion that protrudes from the container body and is to be broken by the external force.

16. The container according to claim 15, wherein:

the part separates an inside and outside of the container body before the form of the identifier is changed and allows the air to flow between the inside and outside of the container body after the form of the identifier is changed.

* * * * *